US005263697A

United States Patent [19]

Yamazaki et al.

[11] Patent Number: 5,263,697

[45] Date of Patent: Nov. 23, 1993

[54] FINISHER FOR AN IMAGE FORMING APPARATUS

[75] Inventors: Hideo Yamazaki, Tokyo; Kazunori Kubota, Yokohama; Yuichi Fujii, Okazaki; Mituru Ichikawa, Nishio; Yukitaka Nakazato; Kenji Yamada, both of Tokyo; Yasuo Kosuga, Kawasaki, all of Japan

[73] Assignee: Ricoh Company, Ltd., Tokyo, Japan

[21] Appl. No.: 773,547

[22] Filed: Oct. 9, 1991

Related U.S. Application Data

[63] Continuation-in-part of Ser. No. 505,452, Apr. 6, 1990, Pat. No. 5,083,760.

[30] Foreign Application Priority Data

| | | | |
|---|---|---|---|
| Apr. 18, 1989 | [JP] | Japan | 1-45537 |
| Apr. 18, 1989 | [JP] | Japan | 1-98382 |
| Apr. 18, 1989 | [JP] | Japan | 1-98383 |
| Apr. 20, 1989 | [JP] | Japan | 1-101269 |
| Apr. 20, 1989 | [JP] | Japan | 1-101270 |
| Oct. 12, 1990 | [JP] | Japan | 2-274336 |
| Nov. 19, 1990 | [JP] | Japan | 2-314786 |

[51] Int. Cl.[5] ..... B42B 2/00; B42B 2/02

[52] U.S. Cl. ..... 270/53

[58] Field of Search ..... 270/37, 52, 53, 58

[56] References Cited

U.S. PATENT DOCUMENTS

| | | | |
|---|---|---|---|
| 3,265,274 | 8/1966 | Burnell | 227/103 X |
| 4,358,197 | 11/1982 | Kukucka | 270/58 |
| 4,552,497 | 11/1985 | Kockler et al. | 270/53 X |
| 5,005,751 | 4/1991 | Radtke | 270/53 |
| 5,029,831 | 7/1991 | Green | 270/53 |
| 5,131,641 | 7/1992 | Hidaka | 270/53 |

FOREIGN PATENT DOCUMENTS

| | | | |
|---|---|---|---|
| 0127977 | 5/1988 | Japan | 270/53 |
| 279389 | 11/1990 | Japan | 270/53 |
| 9005641 | 5/1990 | PCT Int'l Appl. | 270/53 |

*Primary Examiner*—Edward K. Look
*Assistant Examiner*—John Ryznic
*Attorney, Agent, or Firm*—Oblon, Spivak, McClelland, Maier & Neustadt

[57] ABSTRACT

A finisher capable of binding a stack of sheets at a plurality of desired positions by a single stapler. When a plurality of stacks of sheets should be each stapled at two positions, the stapler is controlled such that the last stapling position of the preceding stack is the position where the following stack is stapled first.

3 Claims, 23 Drawing Sheets

FINISHER FOR AN IMAGE FORMING APPARATUS

CROSS REFERENCE TO RELATED APPLICATION

This application is a continuation-in-part of copending U.S. application Ser. No. 07/505,452, filed Apr. 6, 1990 now U.S. Pat. No. 5,083,760.

BACKGROUND OF THE INVENTION

The present invention relates to a finisher for use with a copier, printer or similar image forming apparatus and operable to staple or otherwise finish paper sheets which are sequentially driven out of the apparatus.

A finisher of the kind described is generally constructed such that paper sheets sequentially fed out of an image forming apparatus are stacked on a staple tray and then stapled, and the stapled paper stack is let fall onto a discharge tray disposed below the staple tray. This type of finisher is disclosed in Japanese Patent Laid-Open Publication (Kokai) Nos. 62-20046, 62-191375, 62-176246, 62-290669, 59-82263, and 63-101268 by way of example.

The prior art finisher described above has some problems left unsolved, as follows.

(1) The staple tray overlying the discharge tray interferes with the operator's access to the finished paper stack on the discharge tray. The operator cannot reach the finished paper stack without bending down, resulting in troublesome work.

(2) A stapler staples a paper stack at a predetermined position without exception. Especially, there is a fear that the actual stapling position differs from an expected position, depending on the image forming direction or writing direction on the paper sheets.

(3) A problem with a prior art finisher of the type discharging a stapled paper stack onto an overlying tray is that an extra paper transport path and, therefore, an extra space is needed because the tray is disposed above the stapled paper stack.

(4) When the stapled paper stack is directly discharged from the stapler in order to eliminate the extra paper discharge path, it is likely that the paper sheets are creased and/or the number of paper sheets of a stack which can be discharged is decreased.

(5) It is impossible to detect a stapling error and a jam of a stapled stack accurately and efficiently.

(6) A finisher of the type disclosed in Japanese Patent Laid-Open Publication Nos. 82263/1984, 290669/1987 and 101268/1988 binds a stack of sheets only at a predetermined position by a single stapler which is fixed at one corder of the finisher. While this type of finisher is inherently simple in construction, it cannot bind a sheet stack at a position other than the predetermined position. In light of this, there has been proposed a finisher having two staplers, as taught in, for example, Japanese Patent Laid-Open Publication Nos. 13364/1989 and 185774/1988. Although the dual stapler type finisher enhances productivity by binding a sheet stack at two positions at the same time, it is expensive due to the two staplers.

SUMMARY OF THE INVENTION

It is therefore an object of the present invention to provide a finisher for an image forming apparatus which with a miniature configuration promotes easy and efficient manipulations, i.e., frees the operator from the need for bending down.

It is another object of the present invention to provide a finisher for an image forming apparatus which staples a paper stack at an adequate position or positions of the latter.

It is another object of the present invention to provide a finisher for an image forming apparatus which allows a stack of a number of paper sheets to be directly discharged from a stapler to a tray, thereby eliminating the need for an extra paper discharge path.

It is another object of the present invention to provide a finisher for an image forming apparatus capable of feeding paper sheets to a stapler in a desirable manner.

It is another object of the present invention to provide a finisher for an image forming apparatus which detects a stapling error and a jam of a stapled stack accurately and efficiently and thereby promote prompt processing for recovery.

It is another object of the present invention to provide a finisher for an image forming apparatus capable of binding a sheet stack at a plurality of desired positions by a single stapler.

It is another object of the present invention to provide a finisher for an image forming apparatus which has a single stapler and reduces the binding time.

It is another object of the present invention to provide a finisher for an image forming apparatus which reduces the production cost.

It is another object of the present invention to provide a generally improved finisher for an image forming apparatus.

A finisher capable of binding a stack of sheets sequentially discharged from image forming equipment at a plurality of desired positions of the present invention comprises a staple section having a single stapler for binding the stack of sheets at the desired positions, a moving device for moving the staple section via the desired positions, and a control unit for controlling the staple section and moving device such that the stack of sheets is stapled at particular positions selected in matching relation to a designated staple mode.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
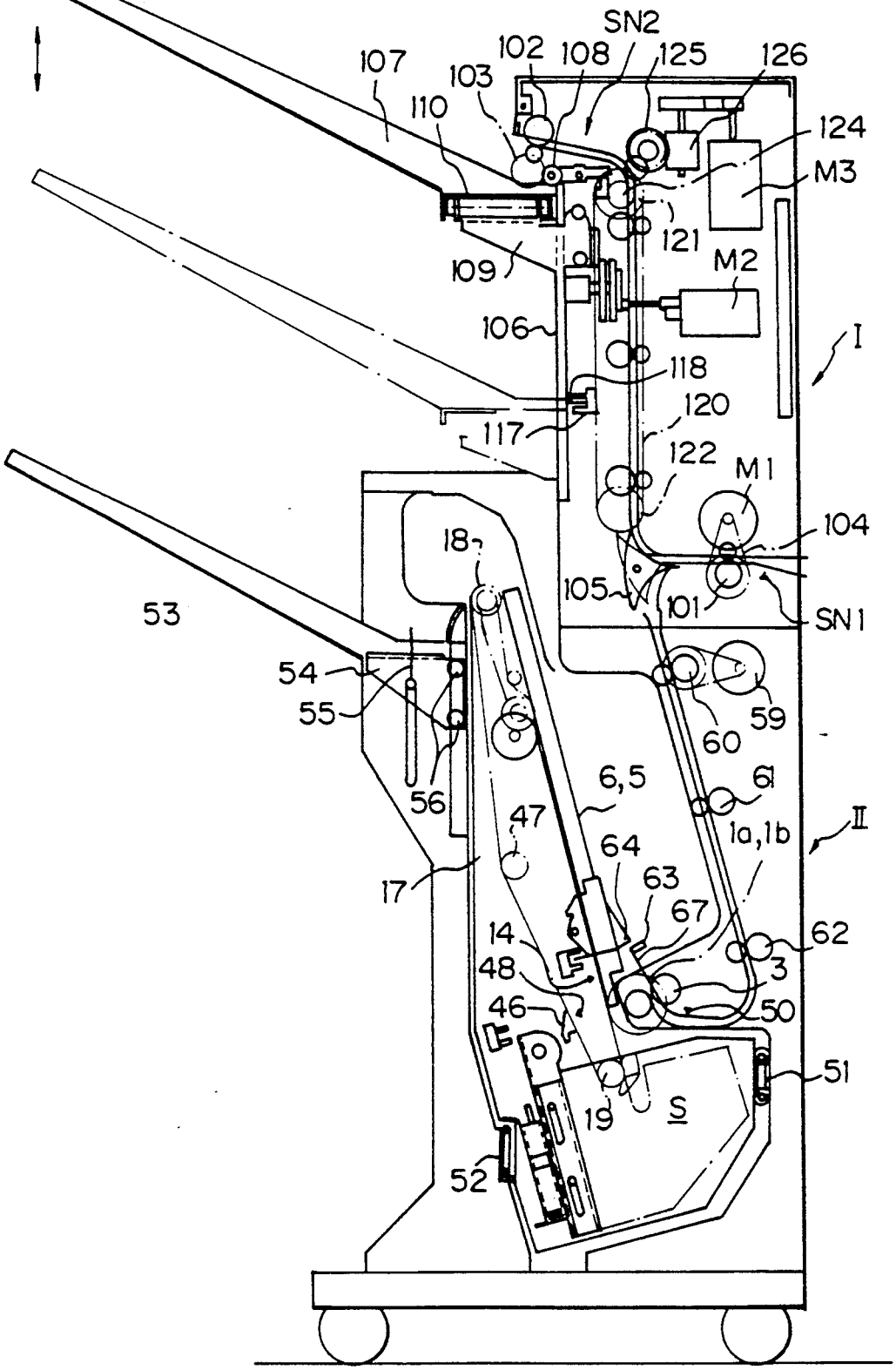
FIG. 1 is a side elevation showing the overall construction of a finisher embodying the present invention.

Referring to FIG. 1 of the drawings, a finisher embodying the present invention is shown which is operatively connected to one side of an image forming apparatus, not shown. As shown, the finisher is generally made up of a shiftable sorting section I and a stapling section II which is disposed below the sorting section 1.

The shiftable sorting section I has a paper transport path along which a plurality of transport rollers and driven rollers associated therewith are arranged. Specifically, a first transport roller 101 is mounted on a shaft which is in driven connection with the output shaft of a transport drive motor M1 through a first timing belt 104. The shaft of the roller 101 is in turn drivably connected by a second timing belt, not shown, to the shafts of the other transport rollers, the shaft of a discharge roller 102, and the shaft of a fur brush 103 which is adapted to position a paper sheet.

Paper sensors SN1 and SN2 immediately precedes the transport roller 101 and the discharge roller 102, respectively. The paper sensors SN1 and SN2 are each responsive to the leading and trailing edges of a paper sheet being transported. A guide pawl 105 is positioned downstream of the transport roller 101 and operated by a solenoid 230 (FIG. 9) and a spring, not shown, to select either one of a transport path extending to the stapling section II and a transport path extending to the sorting section I.

Figure 2:
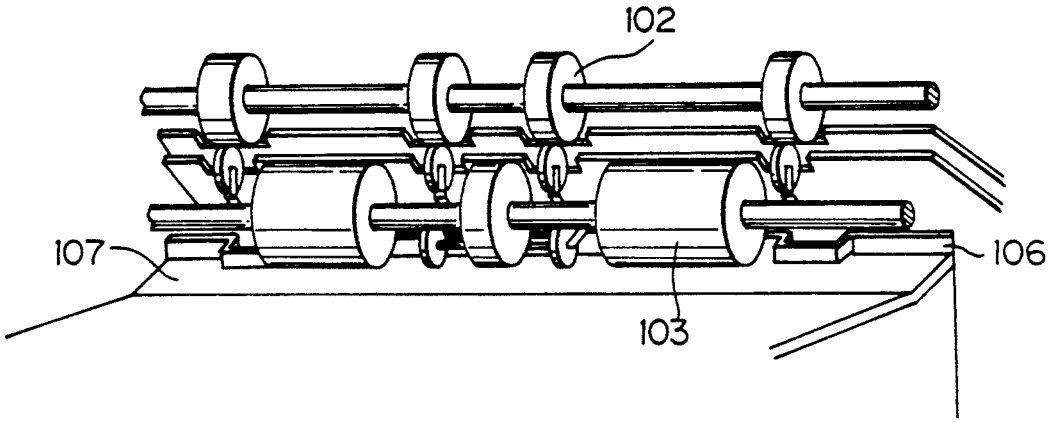
FIG. 2 is a perspective view of a paper discharging section associated with an upper tray.
Figure 3:
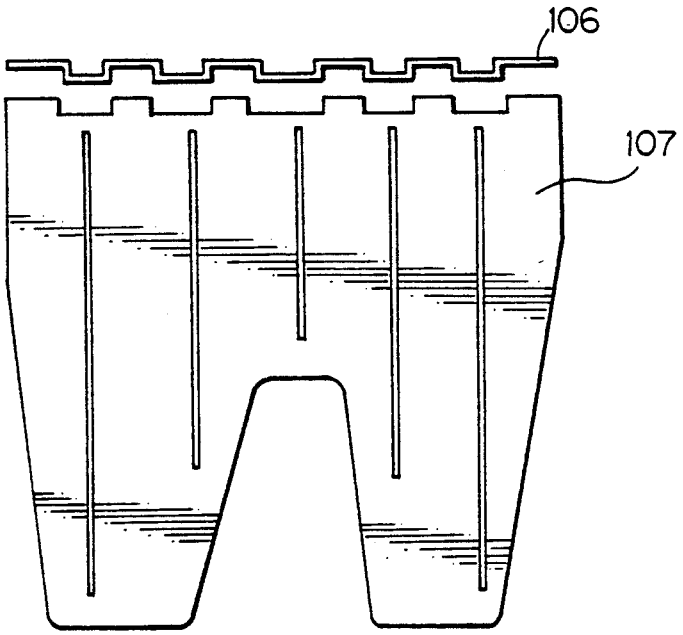
FIG. 3 is a plan view showing the upper tray and a stop plate which is engaged with the upper tray and included in a tray shifting mechanism.
Figure 4:
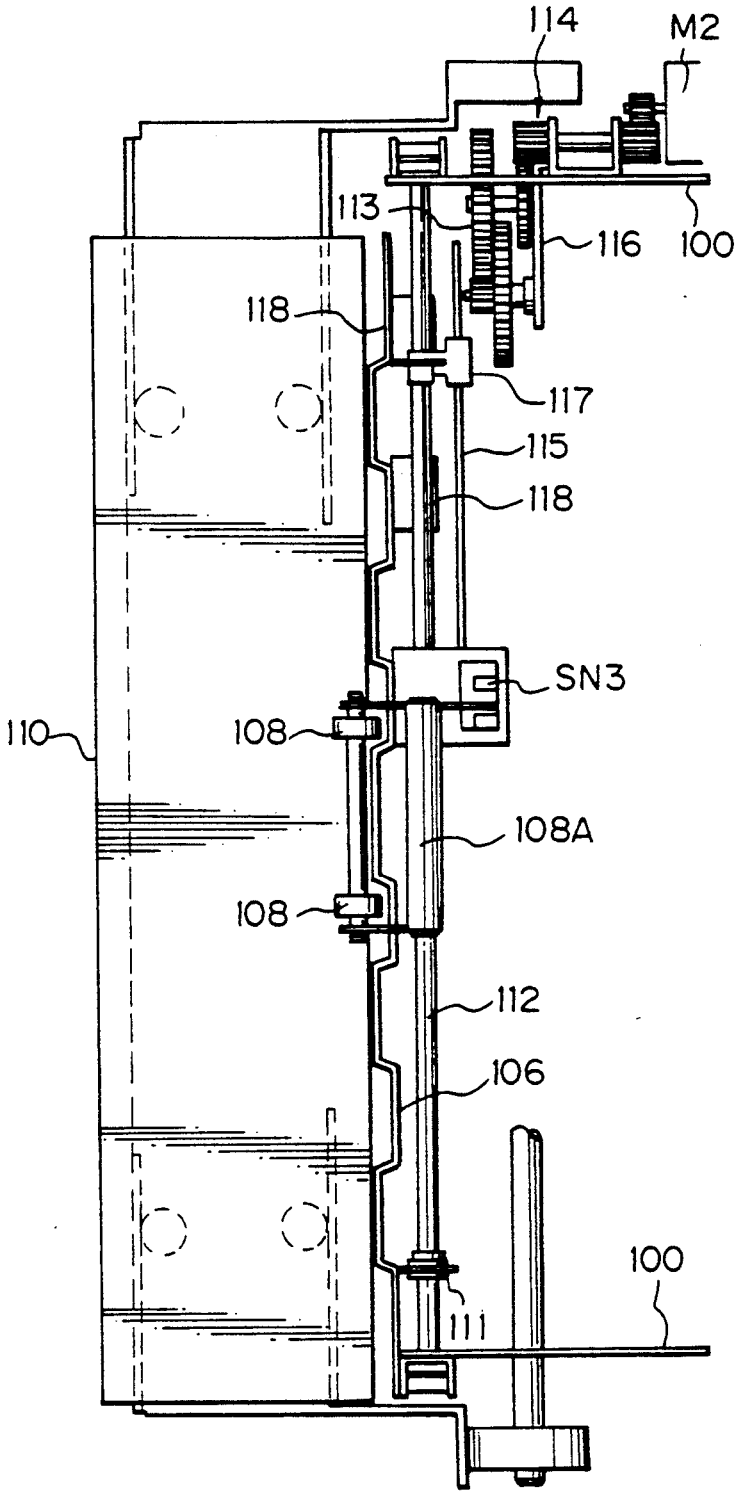
FIGS. 4 and 5 are respectively a plan view and a perspective view each showing a drive line included in the tray shifting mechanism.

As shown in FIGS. 2, 3 and 4, the fur brush 103 is disposed just below the discharge roller 102 in the vicinity of a paper outlet. A paper sheet dropped onto an upper tray or discharge tray 107 is shifted by the fur brush 103 into abutment against a stop plate 106, so that its leading edge is regulated in position.

Figure 5:
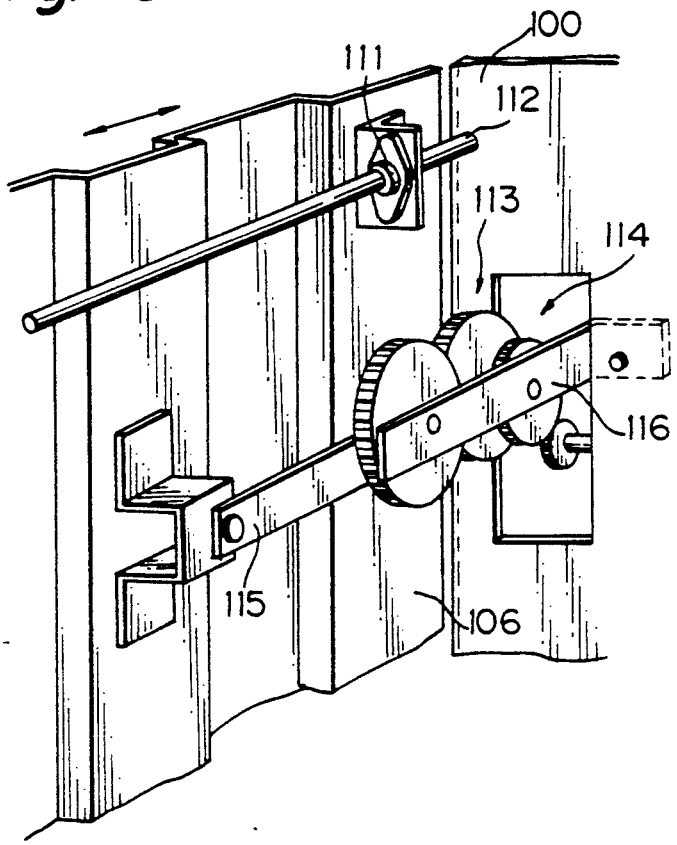

As FIG. 3 indicates, the stop plate 106 and upper tray 107 are provided with projections and recesses which mate with each other. In this configuration, the tray 107 is freely movable up and down (direction perpendicular to the sheet surface of FIG. 3) relative to the stop plate 106 and movable backward and forward (left-and-right direction in FIG. 3) interlocked with the stop plate 106. As shown in FIGS. 4 and 5, the stop plate 106 is mounted on a rod or shift guide 112 through a bearing 111 at the side adjacent to the image forming apparatus and, therefore, free to move backward and forward. As also shown in FIG. 5, the stop plate 106 is connected to a crank 113 by an arm rod 115 in an eccentric position. The crank 113 has an axis of rotation which extends parallel to the center axis of the image forming apparatus, e.g. a copier. A bracket 116 is removably mounted on a side wall 100 and extends perpendicularly from the latter. A gear train 114 is mounted on the bracket 116 to operatively connect the crank 113 to a shift motor M2. The shift motor M2 drives the crank 113 so that the stop plate 106 is caused into a reciprocating motion due to the eccentric rotation of the crank 113. Then, the stop plate 106 moves the discharge tray 107 backward and forward, as stated earlier. A shift sensing plates 118 protrude from the stop plate 106 and are spaced apart from each other by a distance which is substantially the same as the displacement defined by the crank 113. A shift sensor 117 is located to face the stop plate 106 so as to detect the end of an iterative operation consisting of the abutment of a paper sheet and the shift of the tray 107.

Figure 6:
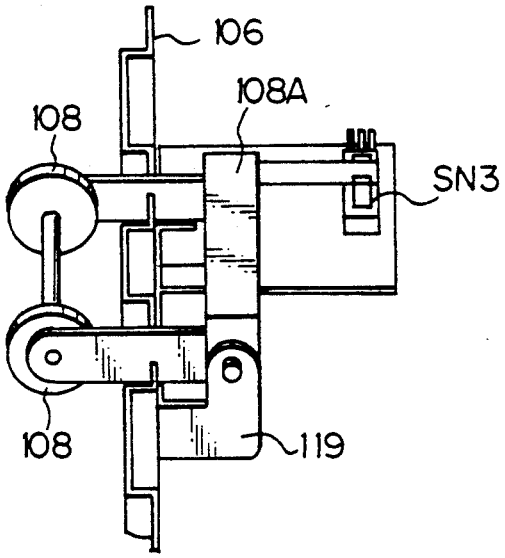
FIG. 6 is a perspective view of a paper pressing mechanism.

As also shown in FIG. 6, a bracket 119 is rigidly mounted on the stop plate 106. Presser rollers 108 are supported by the bracket 119 in such a manner as to be rotatable and movable up and down, thereby constantly pressing itself against the top of a paper stack by gravity. Specifically, a paper sheet is caused to get under the presser rollers 108 by gravity and the force of the fur brush 103 until it abuts against the stop plate 106. When the upper tray 107 is shifted as stated earlier, the presser rollers 108 serve to prevent paper sheet from being dislocated. A paper surface sensor SN3 is mounted on the finisher body to face the presser rollers. When the presser rollers 108 are raised by paper sheets which are sequentially tacked on the tray 107, the paper surface sensor SN3 senses a part of a roller support bracket 108A and thereby determines that the top of the paper stack or the upper surface of the discharge tray 107 has reached a predetermined height.

Figure 7:
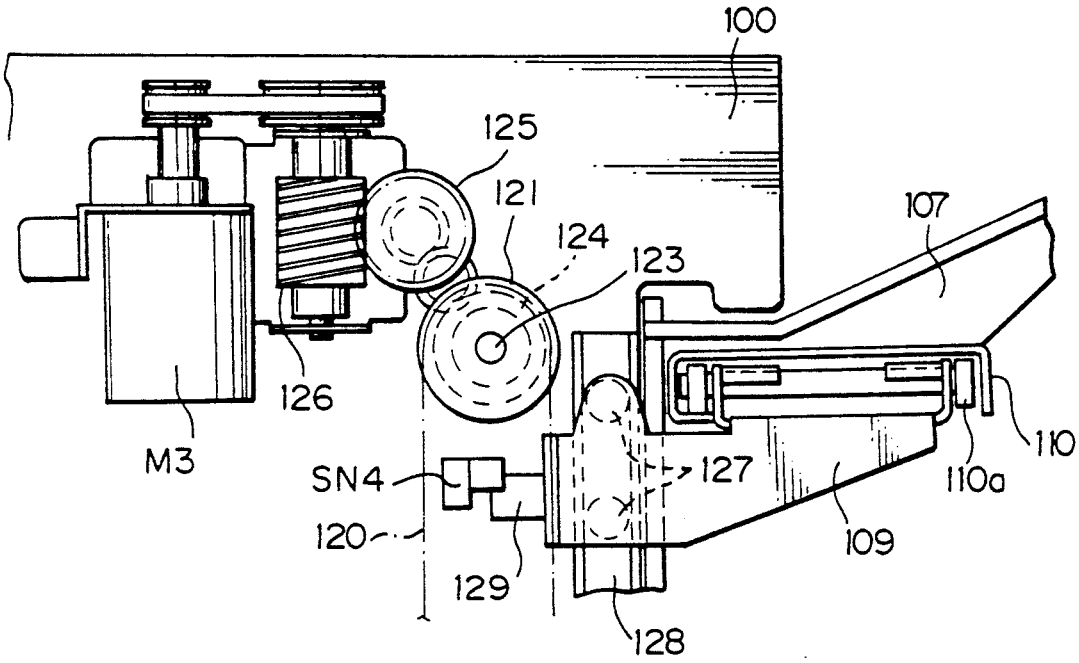
FIGS. 7 and 8 are respectively a side elevation and a perspective view of a mechanism for moving the upper tray up and down.
Figure 8:
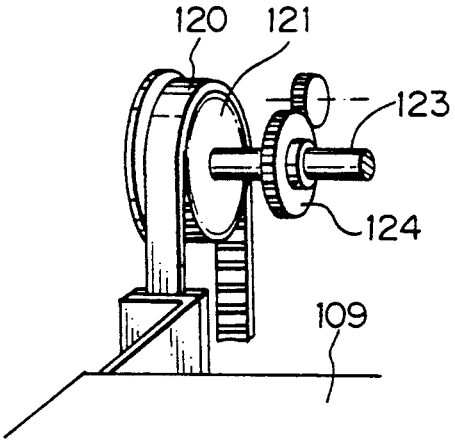

Referring to FIGS. 7 and 8, an elevating mechanism includes a tray support 110 on which the upper tray 107 is rigidly mounted. The tray support 110 is in turn loaded on a tray mount 109 through bearings 110*a* in such a manner as to be movable back and forth thereon. This allows the tray 107 to be shifted in the previously described manner by the stop plate 106 on the tray mount 109. The tray mount 109 is affixed to a third timing belt 120, as also shown in FIG. 1. The third timing belt 120 is located at the outside of each of the front and rear side panels 100. Each timing belt 120 is passed over a drive pulley 121 and a driven pulley 122. The two drive pulleys 121 are securely mounted on a drive shaft 123 which extends throughout the opposite side panels 100. A gear 124 is mounted on the drive shaft 123 and has a one-way clutch thereinside. The one-way clutch is so constructed as to transmit a force acting in a direction for elevating the discharge tray 107 to the drive shaft 123. The gear 124 is connected to an elevation motor M3 by a gear train, a worm wheel 125, and a worm 126. Bearings 127 are mounted on the sides of the tray mount 109 which face the side panels 100, while guide rails 128 are mounted on the side panels 100. The bearings 127 and guide rails 128 are mated together to guide the up-and-down movement of the tray mount 109 while preventing the tray 107 from falling due to the moment of rotation ascribable to gravity.

In the above-described mechanism, the upper tray 107 is usually prevented from moving downward due to the retaining force of the worm 126 and the locked state of the one-way clutch. When the elevation motor M3 is driven in a direction for elevating the tray 107, the one-way clutch is locked to rotate the pulleys 121 and 122 with the result that the tray 107 is elevated. When the motor M3 is rotated in the other direction, i.e., in a direction for lowering the tray 107, the one-way clutch is unlocked to allow the tray 107 to move downward due to gravity.

Figure 9:
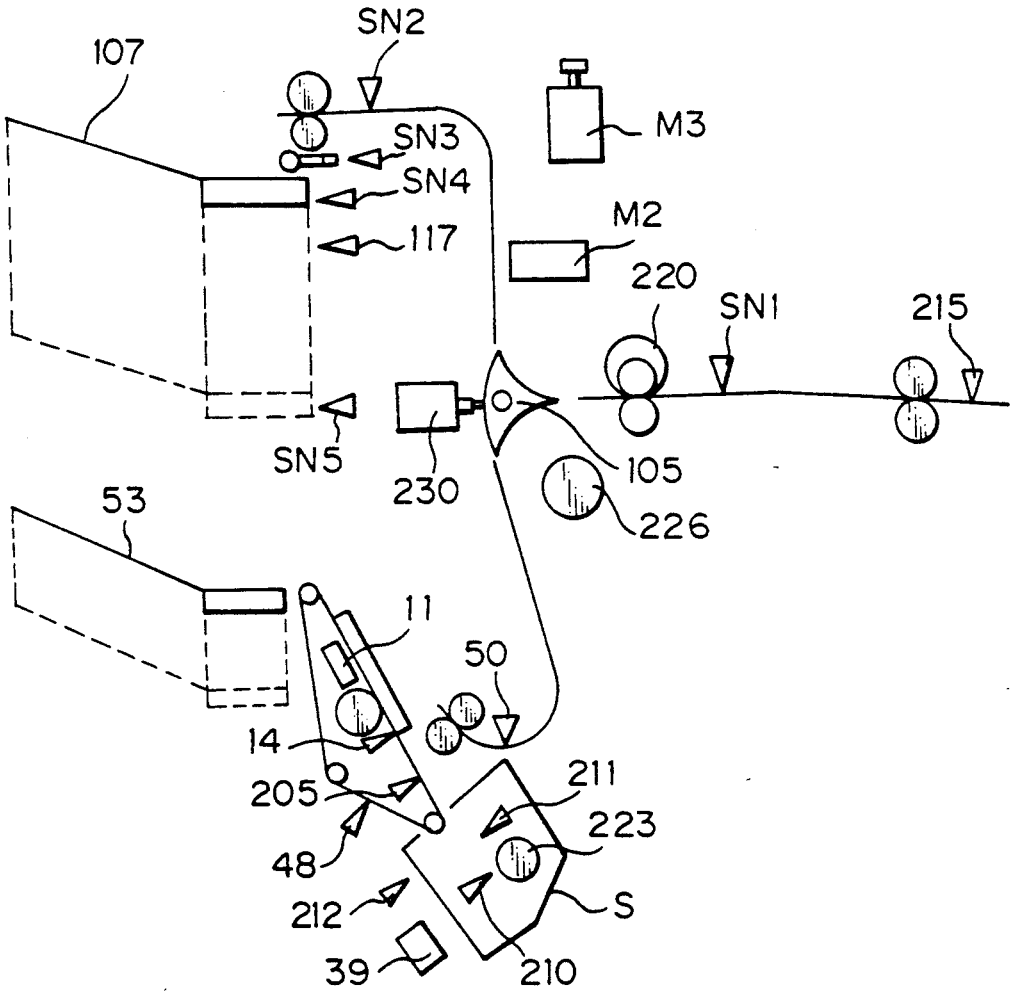
FIG. 9 is a schematic side elevation representative of a paper discharging arrangement.

As also shown in FIG. 9, an upper limit sensor SN4 and a lower limit sensor SN5 are disposed inward of the timing belts 120 and to face the tray 107. The sensors SN4 and SN5 sense respectively the upper limit position and the lower limit position of the tray 107 in cooperation with an elevation sensin plate 129. While the tray 107 is in a downward movement, the oneway clutch is unlocked and, therefore, the rotation of the elevation motor M3 is not transmitted to the tray 107. Hence, even when the tray 107 is held in a halt by an externally derived force during the downward movement, the motor M3 simply idles and is, therefore, free from overloads while preventing, for example, the operator's fingers from being caught.

When a copying operation begins, the shift motor M2 is driven to rotate the crank 113. In turn, the crank 113 moves the stop plate 106 in the back-and-forth direction via the rod 115. The stop plate 106 in turn begins to shift the tray 107 in the same direction. As soon as the shift sensor 117 senses one of the shift sensing plates 118 which is different from the other which it has sensed before the start of the shifting operation, the shift motor M2 is deenergized to end the shifting operation. Thereupon, the elevation motor M3 is driven in the direction for elevating the discharge tray 107. As the paper surface sensor SN3 senses a part of the bracket 108A which supports the presser rollers 108, the elevation motor M3 is deenergized to stop the elevation of the tray 107.

The feed roller 101 receives a paper sheet having been driven out of the copier at the same linear speed as the discharge speed of the copier. As the first paper sensor SN1 senses the trailing edge of the paper sheet, the linear speed is switched to a higher speed which is higher than the discharge speed of the copier. On the lapse of a predetermined period of time after the second paper sensor SN2 has sensed the leading edge of the paper sheet, the linear speed is switched over to the original or lower speed. Then, the paper sheet is driven out onto the tray 107. The paper sheet gets under the presser rollers 108 due to gravity and the force of the rotating fur brush 103 until it abuts against the stop plate 106, whereby the trailing edge of the paper sheet is regulated in position.

When more than a predetermined number of paper sheets, or copies, are stacked on the tray 107, the shift motor M2 is driven to start shifting the tray 107. On completing a single shifting operation, the shift motor M2 is deenergized. As a result, the position of the paper stack on the tray 107 is changed and thereby sorted on the tray 107. When a copy produced by the last one of a sequence of copying cycles is discharged onto the tray 107, the elevation motor M3 is rotated in the direction for lowering the tray 107. The tray 107 is brought to a stop when moved downward over a predetermined distance.

More specifically, assume that a predetermined number of paper sheets have been stacked on the upper tray 107 with the top of the stack being positioned near the paper outlet. Then, the paper sensor SN3 senses a part of the bracket 108A to drive the elevation motor M3 in the direction for lowering the tray 107. This cancels the retaining force of the worm 126 and unlocks the one-way clutch, causing the tray 107 to move downward by gravity. As the top of the paper stack on the tray 107 is lowered to such a level that the paper sensor SN3 does not sense the bracket 108A any longer, the elevation motor M3 is deenergized. Then, the one-way clutch is locked to stop the movement of the tray 107 in cooperation with the worm 126. When the tray 107 is lowered until the lower limit sensor SN5 senses the elevation sensing plate 129, the motor M3 is deenergized to prevent the tray 107 from being lowered any further.

Referring to FIGS. 1, 10, 11 and 12, a mechanism for moving a stapler S included in the stapling section II will be described. The stapler S is rigidly mounted on a stapler mount 31. A guide pin 32 extends out from the stapler mount 31 and is received in a guide slot **30*b* which is formed through a stapler slider 30. In this configuration, the stapler mount 31 is movable in a direction indicated by an arrow l in FIG. 2. A shaft 44 is mounted on the back of the stapler mount 31, while a guide roller 34 is rotatably mounted on the shaft 44. A guide rod 36 is supported at opposite ends thereof by side plates 41 and 42. The stapler slider 30 is mounted at an upper portion thereof on the guide rod 36 and slidable along the latter in a direction perpendicular to the sheet surface of FIG. 12. A guide roller 33 is provided on a lower portion of the stapler slider 30 and rolls on the surface of a stay 43 which is mounted on the finisher body, thereby restricting the stapler slider 30 with respect to the angular movement. A guide cam 35 is affixed to the stay 43 and provided with a cam surface at the upper end thereof. The guide roller 34 rollably rests on the cam surface of the guide cam 35. In this configuration, the stapler slider 30 is movable in a reciprocating motion as indicated by an arrow k in FIG. 10. The intermediate portion of the guide cam 35 is recessed downward so as to cam the stapler slider 30**.

Figure 10:
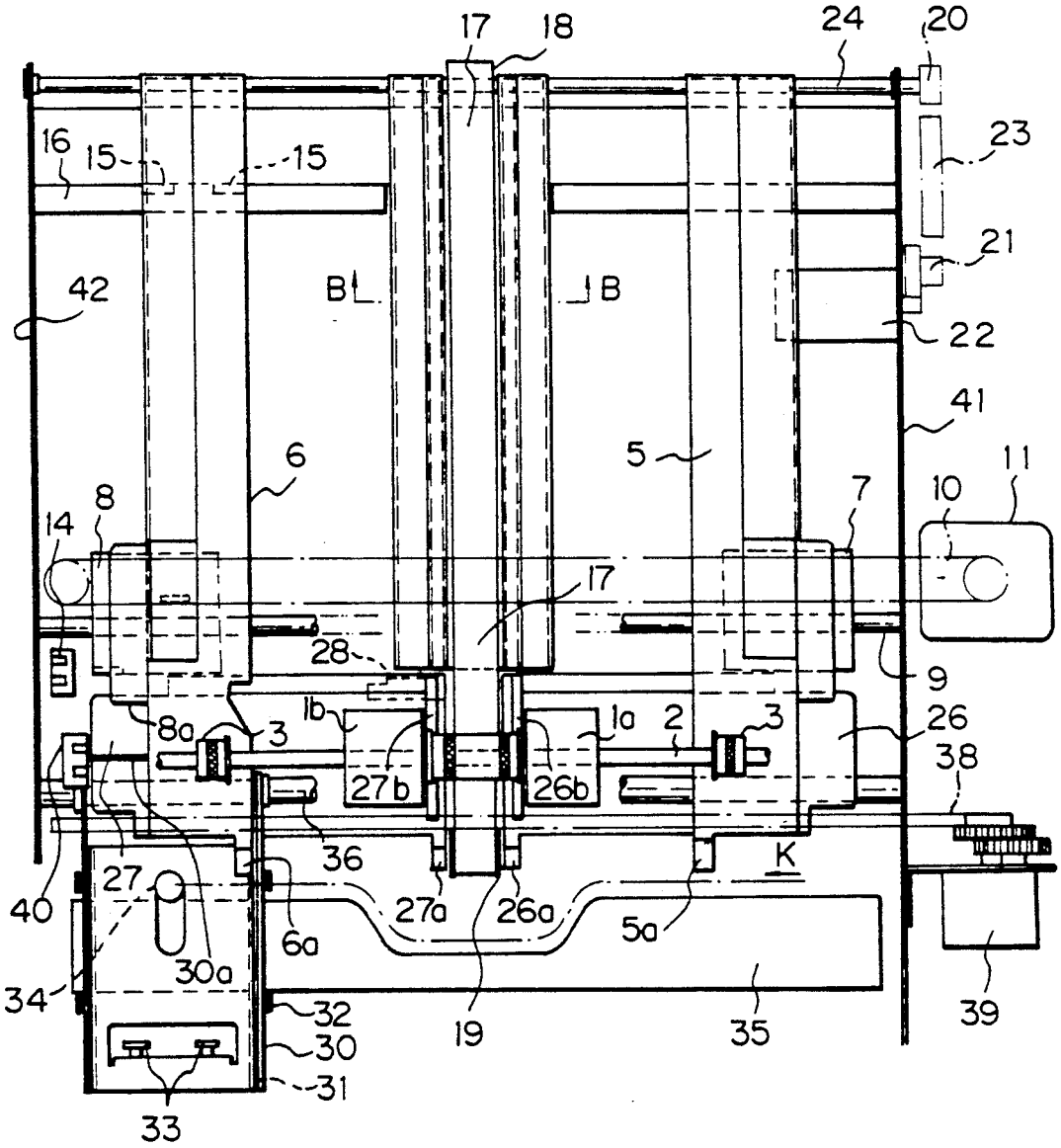
FIGS. 10 and 11 are respectively a front view and a bottom view of a stapling section.
Figure 11:
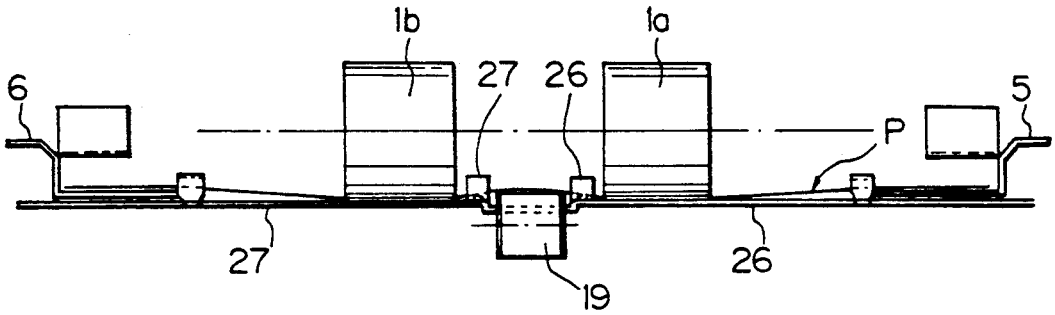
Figure 12:
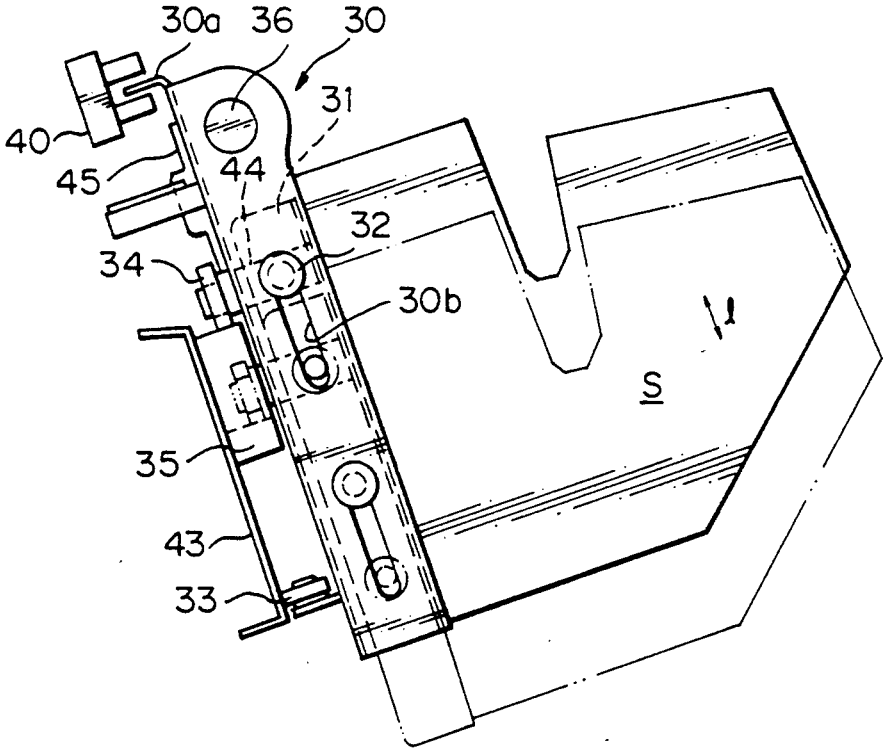
FIG. 12 is a side elevation representative of a structure for mounting a stapler.

A sensing plate **30*a* is mounted on the upper end of the stapler slider 30, while a home position sensor 40 having a sensing section is mounted on the finisher body. When the sensing plate 30*a* blocks the sensing section of the home sensor 40, the home position (HP) of the stapler S is sensed. A stepping motor 39 for moving the stapler S is mounted on the side wall 41, as shown in FIG. 10. The motor 39 drives a belt 38 to which the stapler slider 30 is affixed. Hence, the belt 38 drives the stapler slider 30 in the right-and-left direction of FIG. 10 by way of the belt 38**.

Figure 13:
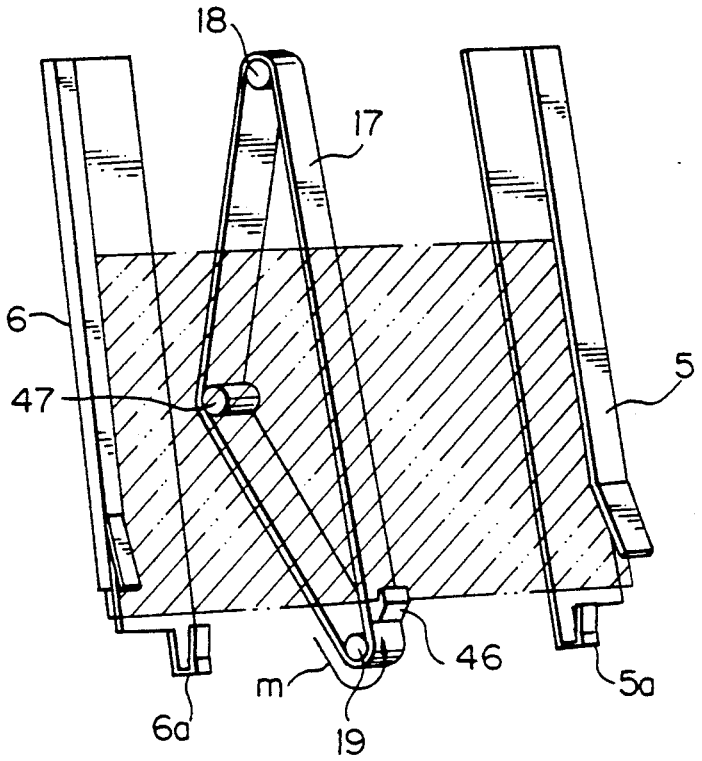
FIG. 13 is a perspective view of a discharging device associated with a lower tray.

A mechanism for moving jogger fences will be described with reference to FIGS. 10 and 13. As shown, the mechanism includes a jogger fence rod 9 extending between the opposite side walls 41 and 42. A right slider 7 and a left slider 8 are mounted on the jogger fence rod 9 to be movable in a reciprocating motion therealong. A right jogger fence 5 and a left jogger fence 6 are rigidly mounted on the right and left sliders 7 and 8, respectively. The jogger fences 5 and 6 function to neatly arrange a stack of paper sheets in the event of a stapling operation. Also, the jogger fences 5 and 6 extend from the vicinity of discharge rollers 3 to the vicinity of a lower tray or discharge tray 53 so as to play the role of guide members for guiding a stapled paper stack. The jogger fences 5 and 6 are respectively provided with rear end fences 5*a* and 6*a* for sustaining the lower end of a stapled paper stack.

Figure 15:
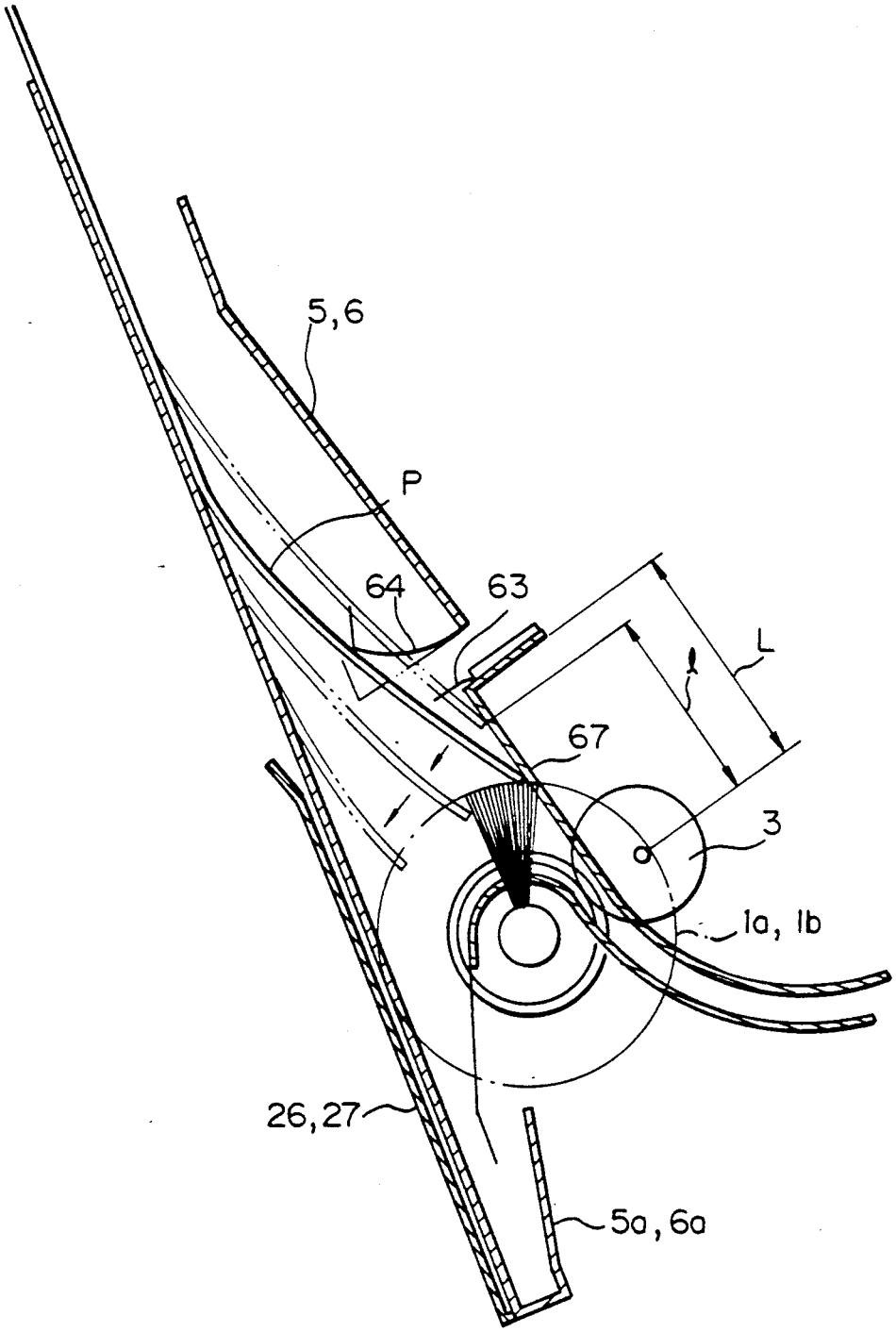
FIG. 15 is an enlarged side elevation of a stapling and discharging section associated with the lower tray.

The right and left sliders 7 and 8 are affixed to a belt 10 which is driven by a jogger fence motor 11. More specifically, each of the sliders 7 and 8 is affixed to a different run of the belt 10 so that their associated jogger fences 5 and 6 may move in a reciprocating motion toward and away from each other in the right-and-left direction as viewed in FIG. 10. Guide rollers 15 are provided on the back of an upper portion of each of the jogger fences 5 and 6. The guide rollers 15 roll on a guide stay 16 which extends between and in an upper portion of the side walls 41 and 42. A sensing plate 8*a* is mounted on the left slider 8. The home position (HP) of jogger fences 6 and 5 is sensed when the sensing plate 8*a* blocks a sensing section of a home position sensor which is mounted on the finisher body. As also shown in FIG. 15, a pressing member 64 is provided at the lower end of each of the jogger fences 5 and 6 for preventing a paper sheet P from curling on the staple tray. The pressing member 64 may be implemented by a resilient member in the form of a polyester film, for example.

Figure 14:
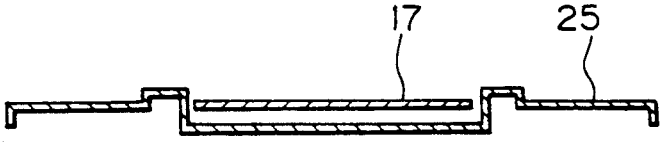
FIG. 14 is a section along line B—B of FIG. 13.

A discharge belt mechanism will be described with reference to FIGS. 10, 13 and 14. A drive shaft 24 is journalled to upper portions of the opposite side walls 41 and 42. A drive pulley 18 is mounted on the drive shaft 24 at substantially the intermediate between opposite ends of the latter. A pulley 19 is located below the drive pulley 18. An endless discharge belt 17 is passed over the pulleys 18 and 19 as well as over an idle pulley 47. A guide plate 25 is located inward of the belt 17 to free the latter from slackening and dislocation. A belt motor 22 is mounted on the side wall 41, while a pulley 21 is mounted on the output shaft of the motor 41. A belt 23 is passed over the pulley 21 and a pulley 20 which is mounted on one end of the drive shaft 24. A pawl 46 (FIGS. 1 and 13) protrudes from the surface of the belt 17 in order to sustain a paper stack, as will be described. As shown in FIG. 4, a home position sensor 48 is positioned between the opposite runs of the belt 17 for sensing the home position (HP) of the pawl 46. The belt 17 is movable at a speed $V_2$ which is equal to or slightly higher than the linear speed $V_1$ of the discharge rollers 3, so that a paper stack to be stapled next may be prevented from being discharged together with a stapled paper stack.

The various mechanisms of the stapler S described above are constructed into a single unit. Such a unit can be pulled out toward the operator along guide rails 51 and 52.

As shown in FIG. 1, a mechanism associated with the lower tray 53 includes a tray mount 54 on which the tray 53 is rigidly mounted. Guide rollers 56 are rotatably mounted on the tray mount 54 and engaged with a guide rail, not shown. The tray 53 is, therefore, movable up and down together with the tray mount 54. A lift spring 55 constantly biases the tray mount 54 upward.

A transport motor 59 is drivably connected to transport rollers 60, 61 and 62 by a belt, not shown. The transport motor 59 is also drivably connected to the discharge rollers 3 by a belt, not shown. Fur brushes 1*a* and 1*b* are mounted on the shaft 2 together with the discharge rollers 3 and are rotatable in synchronism with the rollers 3. The tips of the fur brushes 1*a* and 1*b* are held in contact with guide plates 26 and 27, respectively. The guide plates 26 and 27 have respectively ribs 26*b* and 27*b* for holding the lower end of a stapled paper stack. The guide plates 26 and 27 further have respectively ribs or projections 26*b* and 27*b* on their front faces. The ribs 26*b* and 27*b* and the fur brushes 1*a* and 1*b* cooperate to bend press a paper stack from opposite sides to thereby deform it backward in a wave-like configuration, whereby the paper stack is provided with a certain degree of rigidity.

As shown in FIG. 15, an outlet upper guide plate 67 protrudes beyond the center of rotation of the discharge rollers 3 by an amount L which is greater than an amount l over which an incoming paper sheet P protrudes. Therefore, even when the paper sheet S fails to drop below the fur brushes 1*a* and 1*b* and enters the gap between the upper guide plate 67 and the fur brushes 1*a* and 1*b*, the tips of the fur brushes 1*a* and 1*b* will successfully urge the trailing edge of the paper sheet P downward.

How the finisher handles incoming paper sheets will be described. Assume that the operator selects a staple mode by a staple key, loads a document table (RDH) with N documents, and operates numeral keys to enter a desired number K of volumes of copies. Thereafter, as the operator presses a copy start key, the copier body sends a copy size signal to the finisher. In response, the finisher determines whether or not the stapling section can accommodate paper sheets of the expected size. If the answer of the decision is positive, whether or not the pawl 46 of the discharge belt 17 is located at the home position is determined. If the stapling section cannot accommodate the particular size, the guide member 45 (FIG. 12) is maintained in an OFF state to steer incoming paper sheets toward the upper tray section. If the pawl 46 is not in the home position, the belt motor 22 is driven to return it to the home position. Whether or not the stapler S is in the home position is determined and, if the answer is positive, the stapler S is moved to a predetermined position by the size signal. If otherwise, the stapler S is moved until the home position has been sensed and then moved to the predetermined position by the size signal.

Whether or not the jogger fences 5 and 6 are held in their home position is determined and, if the answer is positive, they are moved to predetermined positions by the size signal. If otherwise, the jogger fences 5 and 6 are moved until the home position has been sensed and then moved to the predetermined positions by the size signal. Specifically, the jogger fences 5 and 6 will each be moved to a position which is a millimeters short of the size width, i.e. 2a millimeters at opposite sides of the size width.

When the inlet sensor SN1 senses the leading edge of a paper sheet, the guide pawl 105 is switched over by the solenoid 230 to steer the paper sheet toward the staple tray. As soon as the leading edge of the paper sheet moves away from the inlet sensor SN1, the transport speed is switched to the higher speed. However, when the paper sheet is not fully driven out of the copier, the transport speed is maintained the same as the transport speed of the copier. The solenoid 230 is deenergized on the lapse of a predetermined period of time after the leading edge of the paper sheet has moved away from the inlet sensor SN1, i.e., when it moves away from the guide pawl 105. The discharge rollers 3 drive the paper sheet onto the staple tray. At this instant, a discharge brush 63 mounted on the upper guide plate 67 dissipates a charge from the paper sheet. The discharge rollers 3 have flanges to deform the paper sheet in a wave-like configuration and thereby provides the latter with a certain degree of rigidity. When the trailing edge of the paper sheet moves away from the rollers 3, the fur brushes 1*a* and 1*b* coaxial with the rollers 3 urge it upward. Consequently, the trailing edge of the paper sheet is caused into abutment against the rear end fences 26*a* and 27*a* and the rear end fences 5*a* and 6*a* extending from the jogger fences 5 and 6. On the lapse of a period of time which is sufficient for the trailing edge of the paper sheet to move away from the paper sensor 50, the motor 11 is rotated forward and then reversed once or twice to cause the jogger fences 5 and 6 to position the paper sheet in the widthwise direction. Thereafter, the jogger fences 5 and 6 are returned to their stand-by position. Such a positioning operation repetitively occurs for each paper sheet and continues until a signal representative of the end of one job, i.e., an end-of-job signal arrives from the copier body.

On the arrival of the end-of-job signal, the above-stated operation is executed again to cause the jogger fences 5 and 6 to hold the paper sheet therebetween. In this condition, a motor 223 (FIG. 9) installed in the stapler S is driven to staple the paper stack. In the event of stapling, whether the paper stack should be stapled at a single position or at two positions is determined. If the paper sheet should be stapled at one position thereof, the jogger fences 5 and 6 are individually shifted to positions which are slightly spaced apart from the paper stack, after the paper sheet has been stapled. If the paper sheet should be stapled at two positions, the stepping motor 39 moves the stapler to another predetermined position to staple the paper stack again and, then,. the stapler is returned to the original position. Then, the discharge belt 17 is rotated as indicated by an arrow m in FIG. 13 to cause its pawl 46 to push the trailing edge of the stapled paper stack upward. As a result, the paper stack is discharged onto the lower tray 53 in the same direction as the direction in which the paper sheets have been fed onto the staple tray.

Subsequently, whether or not the desired K volumes have been fully stapled and discharged is determined. If the answer is positive, the stapler S is moved to its home position. If otherwise, the jogger fences 5 and 6 are shifted to certain positions in response to the size signal, and then the above-stated procedure is executed again.

Regarding the up-down movement of the upper tray 107, at the time of turn-on of power supply or at the time of mode selection, a CPU (Central Processing Unit) checks the upper limit sensor SN4, lower limit sensor SN5 and paper sensor SN3 to see their output states and thereby the current position of the tray 107. If the upper limit sensor SN4 and paper sensor SN3 have been turned on, the elevation motor M3 is energized to lower the tray 107 until the paper sensor SN3 turns off. When only the upper limit sensor SN4 has been turned on, no operation occurs. When all the upper limit sensor SN4, lower limit sensor SN5 and paper sensor SN3 have been turned off, the elevation motor M3 is energized to elevate the tray 107 until either the upper limit sensor SN4 or the paper sensor SN3 turns on; when the paper sensor SN3 turns on, the motor M3 is driven to lower the tray 107 until the paper sensor SN3 turns off. When only the paper sensor SN3 has been turned on, the elevation motor M3 is driven to lower the tray 107 until the paper sensor SN3 goes off. Further, when only the lower limit sensor SN5 has been turned on, the CPU determines that the tray 107 is full and sends a tray full signal to the copier body to urge the operator to remove the paper sheets from the tray 107. On reception of a clear signal from the copier body, the elevation motor M3 is energized to raise the tray 107 until either the upper limit sensor SN4 or the paper sensor SN3 turns off. On the turn-on of the paper sensor SN3, the tray 107 is lowered until it turns off.

When the operation is restarted in the same mode, the same sequence of steps as at the time of mode selection will be executed in response to a copy start signal from the copier body after the turn-on of power supply.

During the copying operation and at the end of the same, when the paper sensor SN3 turns on, the elevation motor M3 is energized to lower the upper tray 107 until the sensor SN3 turns off. Such a procedure is repeated until the lower limit sensor SN5 turns on. Then, a tray full signal is again transmitted to the copier body. When this kind of operation overlaps with the tray shifting operation stated earlier, the former will be performed later with priority given to the latter. When the last paper sheet moves away from a copier discharge sensor 215 (FIG. 9), the copier body sends a finisher stop signal to the finisher. In response, the elevation motor M3 is energized after the last paper sheet has been fed out onto the tray 107, whereby the tray 107 is lowered by a predetermined amount to facilitate the removal of the paper sheets.

Assume that the shifting operation is not executed at the time of the turn-on of power supply and, instead, a shift mode or a proof mode is selected at the time of mode selection. Then, in response to a mode signal, the shift motor M2 is energized to shift the discharge tray 107 and, on the turn-on of the shift sensor 117, deenergized. This is to sort a stack of paper sheets existing on the tray 107 and a stack of paper sheets which will be stacked by the next job. Such a sorting operation will be executed only after the up-down movement of the tray 107 is completed. More specifically, when the tray 107 is shifted as stated above, the presser rollers 108 press the paper sheets and thereby prevent them from being dislocated.

During the copying operation and at the end of the same, the copier body sends a shift signal to the finisher when the last paper sheet or copy moves away from the copier discharge sensor 215. In response, the finisher energizes the shift motor M2 on the lapse of a predetermined period of time after the last paper has moved away from the sensor SN2, thereby starting on a shifting operation. As the shift sensor 117 turns on, the shift motor M2 is deenergized. This operation has priority over the up-down movement of the tray 107 and thereby eliminates the dislocation of paper sheets which would otherwise occur due to the shift.

When the operation is restarted in the same mode, the shift will not be effected at the time of the start of a copying operation and will be effected as stated above while a copying operation is under way.

Operations associated with the jogger fences 5 and 6 are as follows. As shown in FIGS. 1 and 9, on the turn-on of power supply and at the time of mode selection, the CPU checks the jogger home position sensor 14 and a tray paper sensor 205 to see their output states. If only the jogger home position sensor 14 has been turned on, nothing is performed. If both the sensor 14 and the sensor 205 have been turned on, a signal representative of the presence of paper sheets on the staple tray is sent to the copier body. If the sensor 14 is OFF and the sensor 205 have been turned on, the belt motor 22 is energized to drive the paper sheets out of the staple tray to the lower tray 53, then the jogger motor 11 is energized to move the jogger fences 5 and 6 toward their home position, and then the motor 11 is deenergized when the jogger home position sensor 11 turns off. When only the jogger home position sensor 14 has been turned off, the jogger motor 11 is driven to move the jogger fences 5 and 6 toward the home position and, on the turn-on of the sensor 14, the motor 11 is deenergized.

During, at the end of and at the restart of a copying operation, a paper size signal from the copier body arrives at the finisher after the start of copying. In response, the jogger motor 11 is energized to move each of the jogger fences 5 and 6 to a position which is a predetermined amount short of the widthwise paper size and causes it to wait there. As a predetermined time expires after the paper sheet has moved away from the lower paper discharge sensor 50, the jogger motor 11 is driven to move the jogger fences 5 and 6 away from their waiting positions in order to position the paper sheet. Thereafter, the jogger fences 5 and 6 are returned to their waiting positions. More specifically, the jogger motor 11 is rotated forward and then reversed once to several times to neatly arrange the paper sheet in the widthwise direction. Such a positioning action occurs every time a paper sheet arrives at the staple tray.

When the last paper sheet or copy has moved away from the copier discharge sensor 215, a staple signal is sent from the copier body to the finisher. In response, the last paper is discharged onto the staple tray, then positioned, and then restrained by the jogger fences 5 and 6 in the widthwise direction. On completion of the stapling operation, the jogger fences 5 and 6 are shifted to positions each being slightly spaced apart from the associated widthwise edge of the paper stack. As soon as the discharge belt 17 drives the stapled paper stack onto the tray 53, the jogger fences 5 and 6 are returned to the individual waiting positions. In this manner, the jogger fences 5 and 6 prevent the paper stack from being dislocated at the time of stapling and, in addition, serve as a guide when the stapled paper stack is driven out of the staple tray.

The above procedure is repeated until the desired number of volumes of copies have been produced. When the last stapled stack is driven out onto the tray 53, the jogger motor 11 is energized to return the jogger fences 5 and 6 to their home position. As soon as the jogger home position sensor 14 turns on, the motor 11 is deenergized.

At the time of the turn-on of power supply and when a stapler mode is selected, the CPU checks the output states of a one-rotation sensor 210, a staple sensor 211, an a stapler home sensor 212 which are shown in FIG. 9. Depending on the output states of such sensors, the CPU executes the following procedures.

When the tray paper sensor 205 has been turned on with the one-rotation sensor 210 having been turned off, a stapler error signal is transmitted to the copier body. When the tray paper sensor 205 has been turned off, the stapler S is determined to be out of its home position due to previously occurred jam processing, for example. Then, an idle stable request signal is sent to the copier body to cause the stapler to perform an idle stapling action once and then assume the home position.

If the staple sensor 211 has been turned off, a no staple signal is sent to the copier body. When the stapler home sensor 40 (FIG. 12) has been turned on, nothing is performed. If the stapler home sensor 40 has been turned off and the one-rotation sensor 210 has been turned on, the stepping motor 39 is energized to shift the stapler S to the home position; on the turn-on of the stapler home sensor 40, the motor 39 is deenergized. When the one-rotation sensor 210 has been turned off, the program waits by determining that a stapling action has failed or that jam processing has been performed previously. When the one-rotation sensor 210 is turned on by idle stapling or similar artificial processing, the motor 29 is energized to move the stapler S toward the home position. As soon as the stapler home sensor 40 turns on, the motor 39 is deenergized.

During, at the end of and at the restart of copying, when a paper size signal is received after the copier has started on a copying operation, the motor 39 is energized to move the stapler S by a predetermined amount to a particular position matching the paper size. After the last one of the set of paper sheets has moved away from the copier discharge sensor 215, a staple ON signal is sent from the copier to the finisher. In response, the last paper sheet is fed onto the staple tray and, as soon as the jogger fences 5 and 6 retain the paper stack at opposite widthwise edes of the latter, the staple motor 223 is energized to cause a stapling action to occur. The staple drive motor 223 is deenergized when the one-rotation sensor turns on. In a two-position staple mode, the stapler shift motor 39 is energized to move the stapler S over a predetermined distance, and then it is deenergized to cause a stapling action to occur at the second position. On the completion of the stapling operation, the motor 39 is energized to return the stapler S by the predetermined distance to the first position and then deenergized. Such a stapling operation is repeated until a desired number of volumes have been produced. When the last paper stack is stapled, the motor 39 is energized to return the stapler S toward the home position and, on the turn-on of the stapler home sensor 40, it is deenergized.

The discharge belt 17 is operated as follows.

On the turn-on of power supply and at the time of mode selection, the CPU checks the belt home sensor 48, tray paper sensor 205 and one-rotation sensor 210 to see their output states. If the belt home sensor 48 has been turned on and the tray paper sensor 205 has been turned off, no further processing occurs. If both the belt home sensor 48 and the tray paper sensor 205 have been turned off, the CPU determines that the discharge belt 17 has not been returned to the home position, energizes the belt motor 22 to move the belt 17, and deenergizes the motor 22 when the belt home sensor 48 turns on. If the belt home sensor 48 has been turned off and the tray paper sensor 205 has been turned on, the CPU determines that paper discharge has failed and energizes the motor 22 to move the belt 17. When the belt home sensor 48 turns on after the turn-off of the tray paper sensor 205, the motor 22 is deenergized. If the one-rotation sensor 210 has been turned off, the CPU determines that the paper discharge has failed due to a stapling error, for example, and waits until the operator removes the paper stack existing on the staple tray. After the removal of the paper stack, the motor 22 is energized to move the belt 17 and, on the turn-on of the belt home sensor 48, it is deenergized.

During and at the end of copying, when the stapler S staples a paper stack which includes the last paper sheet or copy, the one-rotation sensor 210 turns on to indicate that the stapler S has stapled the paper stack without fail. Thereafter, the belt motor 22 is energized to cause the belt 17 to move the stapled paper stack onto the discharge tray 53. The motor 22 is deenergized when the belt home sensor 48 turns on. This kind of operation is repeated with each of a desired number of paper stacks.

Regarding the transport line associated with the upper tray 107, the transport motor 220 (FIG. 9) is energized in response to a finisher start signal which is fed from the copier body on the start of a copying operation. Specifically, the motor 220 is driven at a lower speed which is the same as the linear speed of the copier body. When a paper sheet driven out of the copier turns on the inlet sensor SN1, a timer is started to see if the paper sheet moves away from the inlet sensor SN1 within a predetermined period of time, i.e., if a jam occurs. When the trailing edge of the paper sheet moves away from the inlet sensor SN1, the sensor SN1 turns off so that the motor 220 is switched to a higher speed to increase the paper transport rate. Further, a timer is started to see if the outlet sensor SN2 turns on within a predetermined period of time in response to the leading edge of the paper sheet, i.e., if a jam occurs. On the lapse of a predetermined period of time after the paper sheet has moved away from the inlet sensor SN1, the motor 220 is switched back to the lower speed to prepare for the entry of the next paper sheet. As the outlet sensor SN2 turns on by sensing the leading edge of the paper sheet, a timer is set to see if the paper sheet moves way from the sensor SN2 within a predetermined period of time.

The procedure described above is repeated thereafter. In the upper tray mode, after the arrival of a shift signal, a shift OK signal appears on the lapse of a predetermined period of time after the last one of a set of paper sheet has moved away from the outlet sensor SN2. Then, a timing for executing a shift is measured. When the last paper sheet is driven out of the copier body, a finisher stop signal arrives at the finisher. In response, the motor 220 is deenergized when a predetermined period of time expires from the time when the last paper sheet has moved away from the outlet sensor SN2.

Regarding the transport line associated with the staple tray, the transport motor 220 is energized by the previously mentioned finisher start signal and rotated at the same speed as the linear speed of the copier body. When the inlet sensor SN1 turns on by sensing the leading edge of a paper sheet, the solenoid 230 and a lower transport motor 226 (FIG. 9) are energized. At the same time, a timer is set to see if the paper sheet moves away from the inlet sensor SN1 within a predetermined period of time, i.e., if a jam occurs. When the trailing edge of the paper sheet moves away from the inlet sensor SN1, the sensor SN1 turns off so that the motor 226 is switched to a higher speed to increase the paper transport rate. A timer is set to see if a lower outlet sensor 50 turns on within a predetermined period of time by sensing the leading edge of the paper sheet, i.e., if a jam occurs. As a predetermined period of time expires after the paper sheet has moved away from the inlet sensor SN1, the solenoid 230 is deenergized. When the outlet sensor 50 turns on in response to the paper sheet, a timer is set to see if the paper sheet moves away from the sensor 50 within a predetermined period of time. When a predetermined period of time expires after the paper sheet has moved away from the outlet sensor 50, the motor 226 is switched over to the lower speed.

After the above procedure has been repeated, a staple signal arrives at the finisher. In response, on the lapse of a predetermined period of time after the last paper sheet of a set of copies has moved away from the lower outlet sensor 50, a staple OK signal appears and a timing for a shift is measured. The copier body sends a finisher stop signal to the finisher when it discharges the last paper sheet, as stated earlier. In response, the motors 220 and 226 are deenergized on the lapse of a predetermined period of time after the last paper sheet has moved away from the outlet sensor 50.

Figure 16:
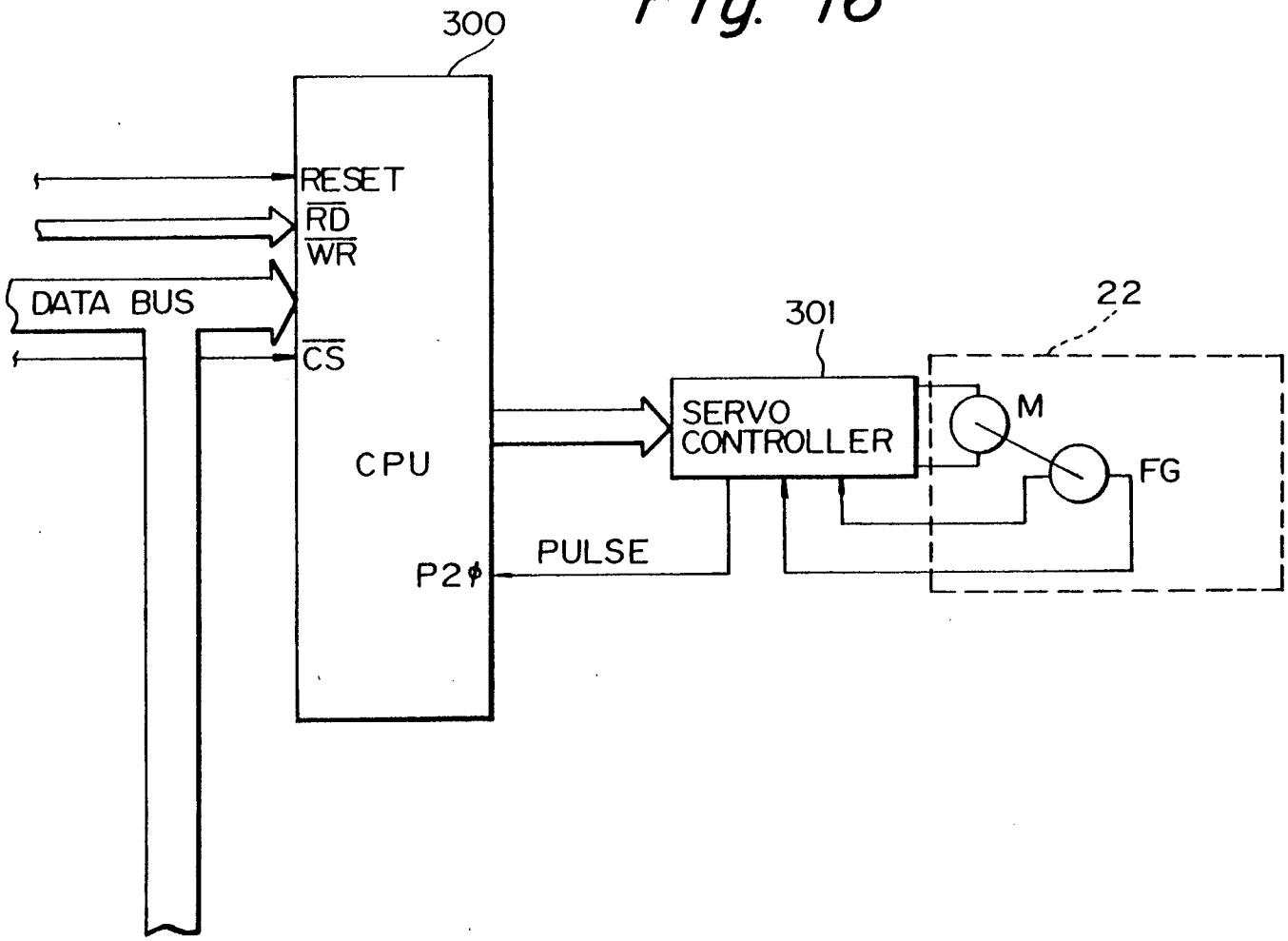
FIG. 16 is a schematic block diagram showing circuitry for detecting a jam on the basis of a motor lock condition.

Referring to FIG. 16, an essential arrangement in accordance with the present invention is shown in a schematic block diagram. As shown, a CPU 300 feeds a motor ON/OFF signal to a servo controller 301 so as to drive the belt motor 22. A tacho-generator (FG) is mounted on the shaft of the belt motor 22 to feed its output to the servo controller 301. The servo controller 301 delivers to a port P20 of the CPU 300 pulses which appear at constant intervals in synchronism with the rotation of the motor 22. Whether or not the motor 22 has been locked is determined on the basis of, for example, whether or not a pulse signal arrives at the port P20 while the CPU 300 is producing a motor ON signal. In practice, the motor 22 is determined to have been locked when a pulse does not arrive over a certain period of time while a motor ON signal is produced.

Figure 17:
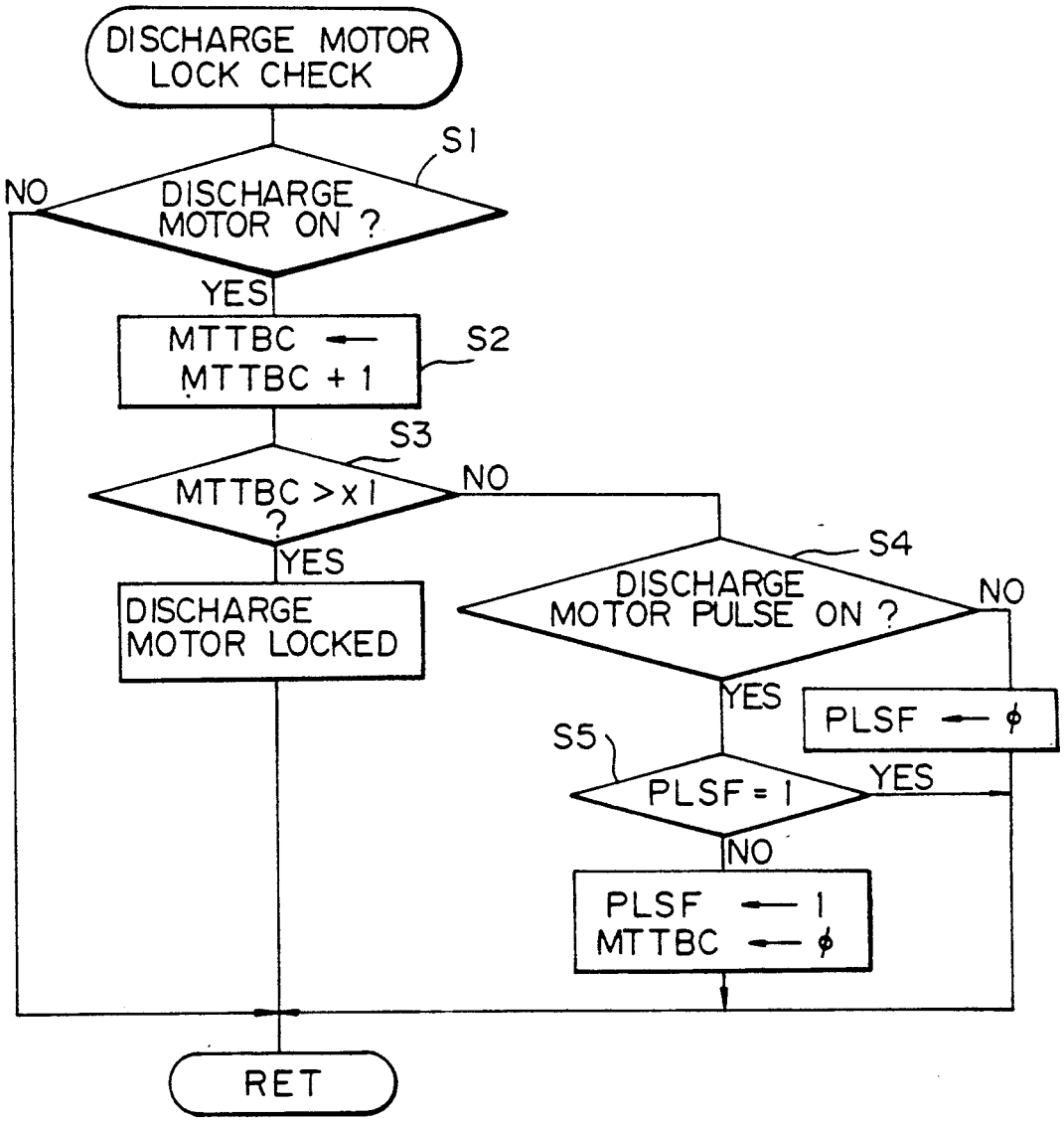
FIG. 17 is a flowchart demonstrating a sequence of steps for detecting the motor lock condition, i.e. a jam.

FIG. 17 is a flowchart demonstrating a procedure for detecting a motor lock condition in the event of paper discharge. The procedure begins with a step S1 for determining whether or not the motor associated with the discharge belt 17 has been energized. If the answer of the step S1 is YES, a counter MTTBC responsive to the motor lock condition is incremented by 1 (one) at a time (step S2). Whether or not the content of the counter is greater than a predetermined value is determined in a step S3. If the answer of the step S3 is YES, it is determined that the motor has been locked. If the answer of the step S3 is NO, pulses which are expected to be produced by the servo controller 301 in response to the rotation of the motor are checked (step S4). If the answer of the step S4 is YES, whether or not a flag PLSF is (logical) ONE is determined (step S5). If the answer of the step S5 is YES, the program returns; if otherwise, the flag PLSF is set to ONE while the counter MTTBC is cleared to "0". The counter MTTBC is cleared to "0" every time a normal pulse arrives and, therefore, does not exceed a predetermined value so far as the operation of the motor is normal. However, once the motor is locked, the counter MTTBC will not be cleared because the pulse signal remains in an ON state or an OFF state. In this subroutine, a motor lock condition is detected when the counter MTTBC which is incremented by 1 at a time exceeds a predetermined value. By such a motor lock detecting procedure, it is possible to detect a stapling error such as the catching of a staple. This, combined with the detection of a stapler home position, is successful in surely detecting stapling errors.

Figure 18:
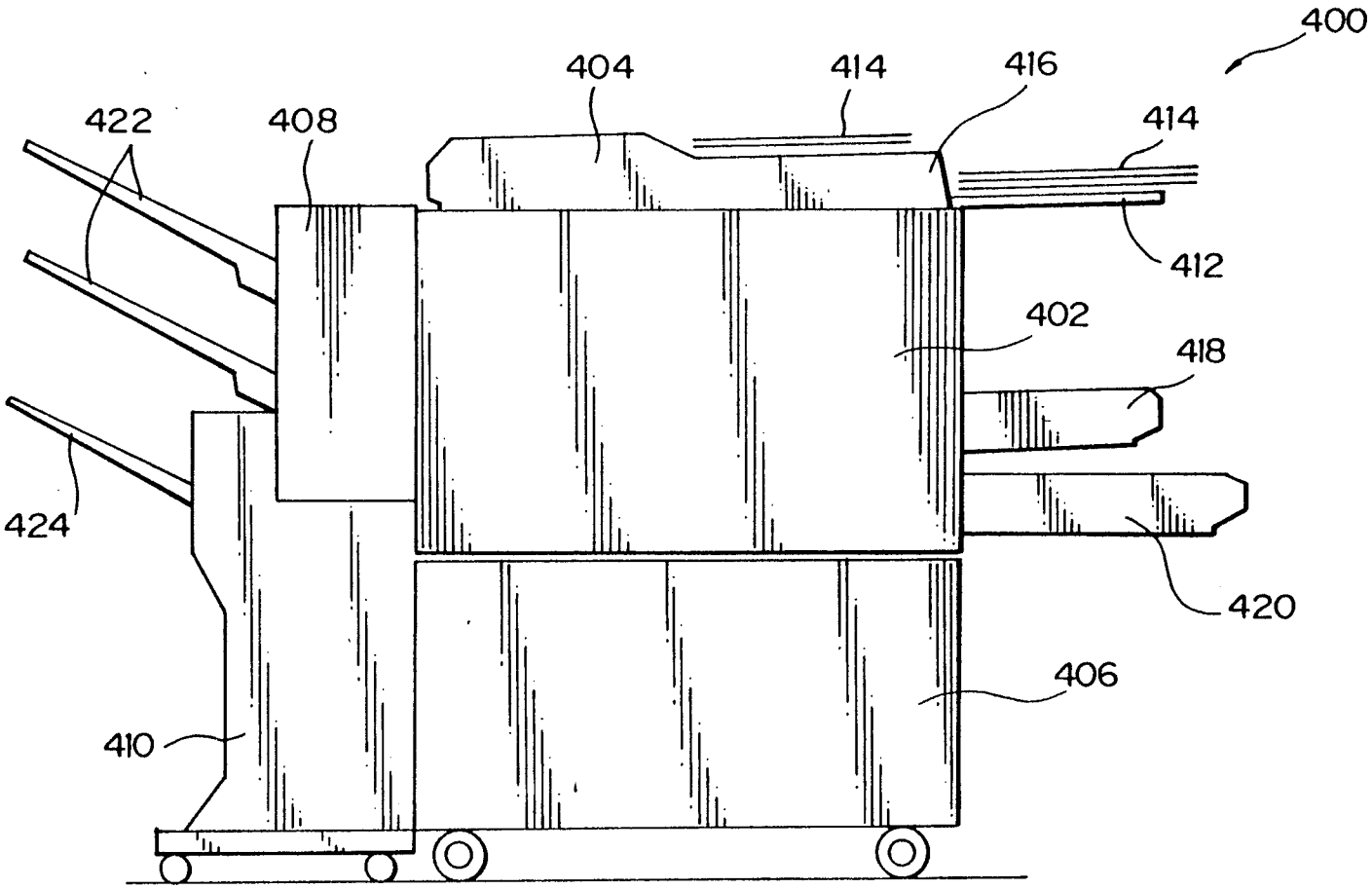
FIG. 18 is an elevation showing an image forming apparatus in the form of a copier to which a finisher embodying the present invention is applied.

Referring to FIG. 18, an alternative embodiment of the present invention will be described. As shown, a copier, generally 400, is made up of a body 402. an ADF 404, a mass sheet feeder 406, and a sheet discharging section 408. A finisher, generally 410, is operatively connected to the discharging section 408. The ADF 404 automatically feeds a stack of documents one by one from a tray 412 to a predetermined illuminating position while driving them out to a table 416. In a two-sided copy mode, the ADF 404 turns over each document and feeds it again to the illuminating position before driving it out to the table 416. To produce a plurality of copies with each of the documents, the ADF 404 cyclically feed the documents a number of times corresponding to the desired number of copies. The mass sheet feeder 406 stores a great amount of sheets which sheet feeding sections 418 and 420 incorporated in the copier body 402 cannot accommodate. The discharging section 408 has a plurality of trays 422 arranged one above another and distributes sheets, or copies, coming out of the copier body 402 in a particular manner matching a sort mode or a stack mode. The finisher 410 functions when a staple mode is selected for stapling stacks of sheets one by one. When a staple mode is selected, sheets carrying images thereon are routed through the discharging section 408 to the finisher 410 and not to the tray 422. Each stack of sheets having been bound, i.e., a copy is discharged to a tray 424. The copier body 402 executes a conventional arrangement for illuminating a document 414, developing the resulting latent image representative of the document 414, transferring the developed image to a sheet, and fixing the image on the sheet, although not described specifically herein.

Figure 19:
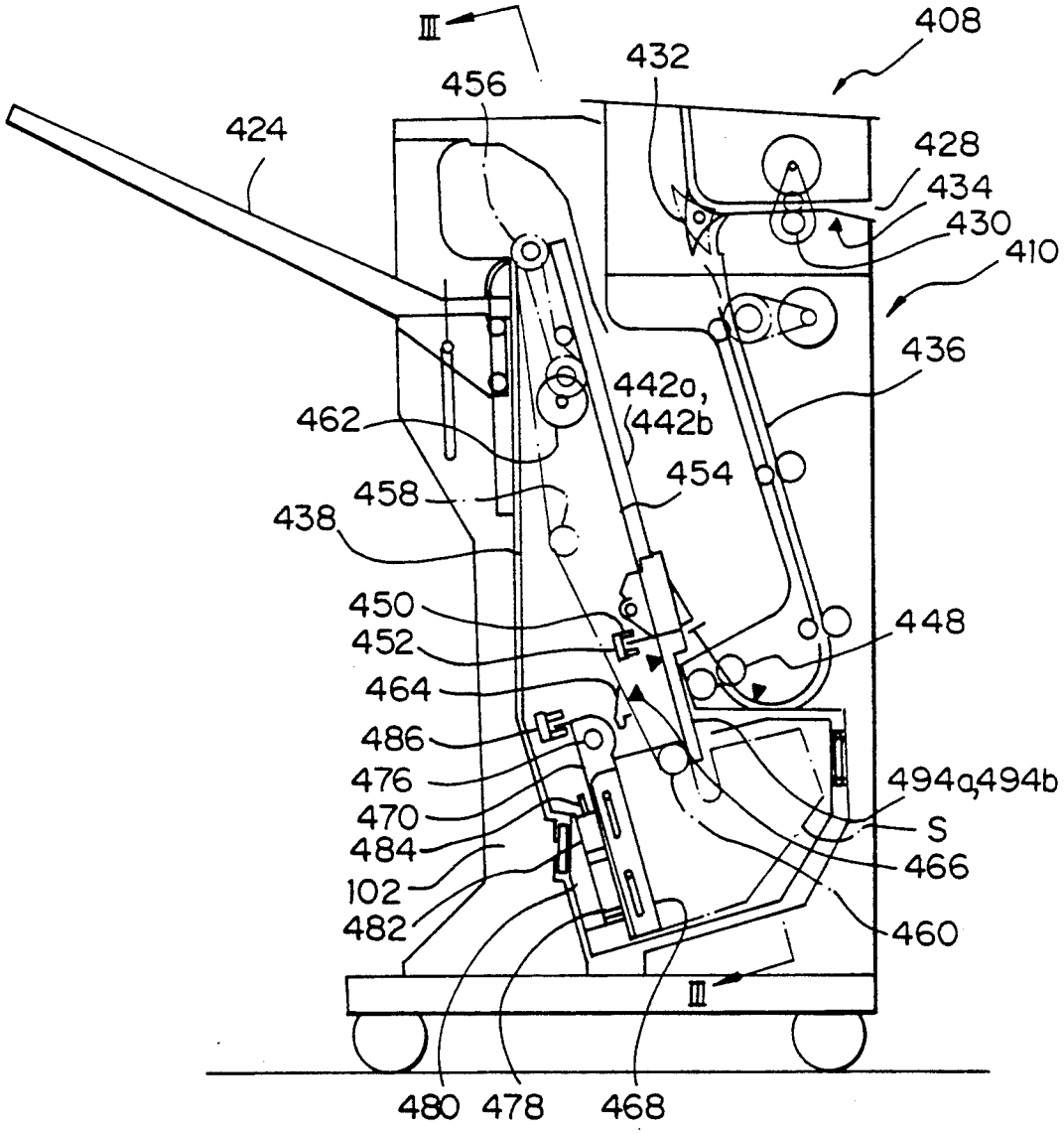
FIG. 19 is a section of the embodiment.

As shown in FIG. 19, the discharging section 408 of the copier 400 has an inlet 428 for receiving a sheet driven out by a discharge roller, not shown, incorporated in the copier body 402. A transport roller 430 transports the sheet into the discharging section 408. A selector in the form of a pawl 432 steers the sheet from the transport roller 430 toward either one of the tray 422 and finisher 410. A sensor 434 is located at the inlet 428 for sensing the leading and trailing edges of the sheet coming in through the inlet 428. The selector 432 is actuated by a solenoid and a spring, not shown.

Figure 20:
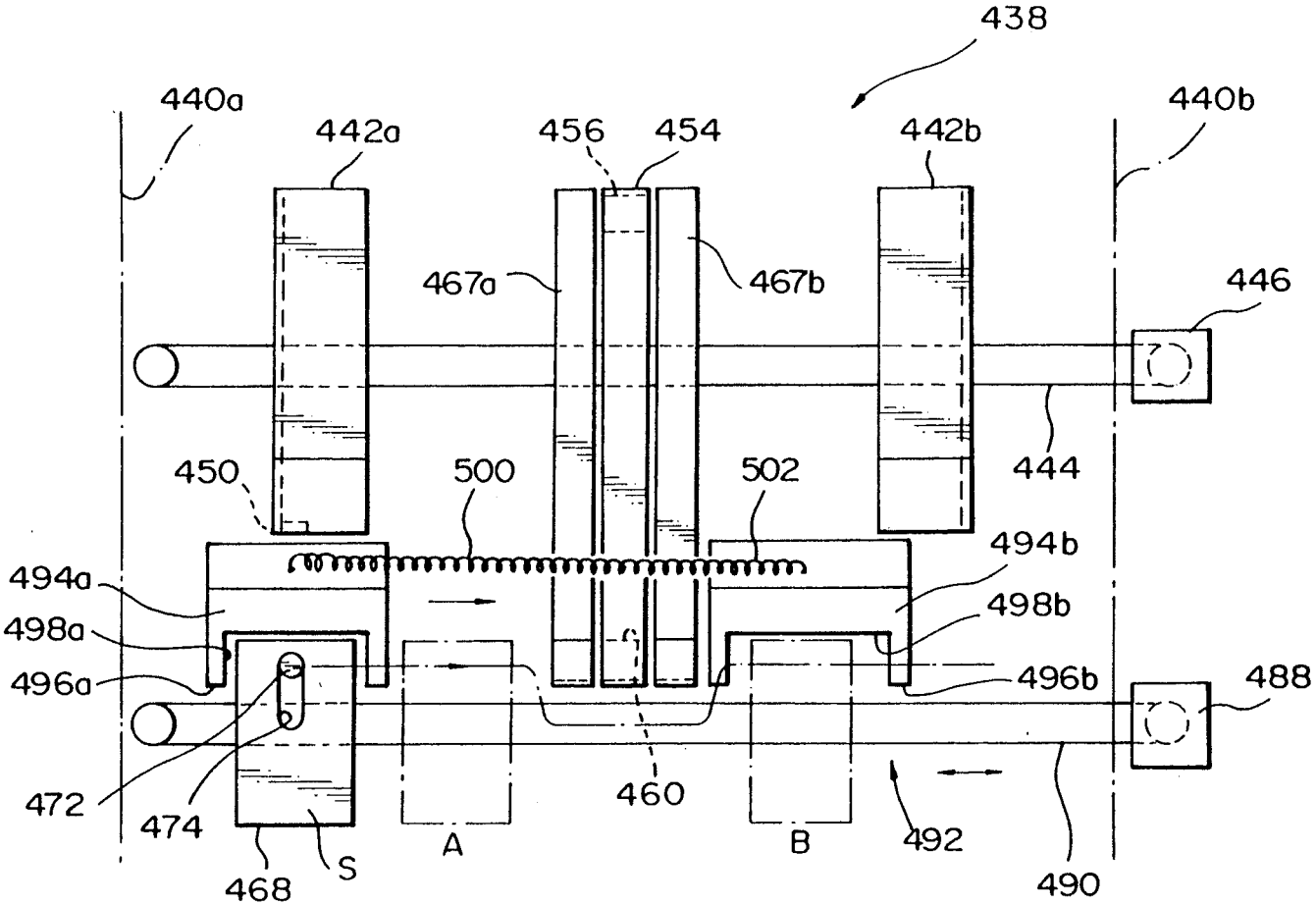
FIG. 20 is a section along line III—III of FIG. 19.

As also shown in FIG. 19, the finisher 410 has a downwardly extending transport path 436 for guiding the sheet steered into the finisher 410 downward, and a staple section 438 held in an inclined position for stapling sheets successively guided along the transport path 436. As shown in FIGS. 19 and 20, the staple section 438 has a pair of jogger fences 442*a* and 442*b* which are each disposed between opposite side panels 440*a* and 440*b* of the staple section 438 in an inclined position. An endless belt 444 is located between the side panels 440*a* and 440*b* perpendicularly to the lengthwise direction of the jogger fences 442*a* and 442*b*. The jogger fences 442*a* and 442*b* are affixed to opposite runs of the belt 444. As the belt 444 is moved by a motor 446, it causes the jogger fences 442*a* and 442*b* to move back and forth symmetrically to each other. While moving in such a reciprocating motion, the jogger fences 442*a* and 442*b* neatly position the right and left ends of a stack of sheets. In addition, the jogger fences 442*a* and 442*b* extend from the neighborhood of a discharge roller 448 located at the end of the downward transport path 436 to the neighborhood of the staple tray 424, serving as a guide member for guiding a stapled stack of sheets or copy to the tray 424. A piece 450 is mounted on the rear and in a lower portion of the jogger fence 442*a* while a home position sensor 452 is mounted on the body of the finisher 410. When the piece 450 acts on the sensing section of the home position sensor 452, the sensor 452 determines that the jogger fences 442*a* and 442*b* have reached their home positions (HP). The jogger fences 442*a* and 442*b* are brought to their home positions before they start on a sheet positioning operation.

An endless discharge belt 454 is located at the intermediate between the side panels 440*a* and 440*b*, FIG. 3, and contained in the same plane as the jogger fences 442*a* and 442*b*. The belt 454 is passed over an upper or drive pulley 456, an intermediate or idle pulley 458, and a lower or driven pulley 460 and driven by a motor 462, FIG. 19. A pawl 464 protrudes from the surface of the belt 454 to sustain a stack of sheets from below. A home position sensor 466 is responsive to the home position of the pawl 464. Guide plates 467*a* and 467*b* are located to guide the belt 454. Binding means in the form of stapler S is affixed to a stapler support 468 which is disposed below the jogger fences 442*a* and 442*b*. Although not shown in the figures, the rotation of a motor is transmitted to an eccentric crank via a gear and then transformed to a linear movement by a lever, so that the stapler S drives a staple into sheets. The stapler support 468 has a guide slot 474 in which a guide pin 472 studded on a stapler slider 470 is movably received. The stapler slider 470 is disposed below the stapler support 468. In this configuration, the stapler support 468 is movable in one direction, i.e., toward the jogger fence 442*a* or 442*b*.

Specifically, the stapler slider 470 is mounted on a guide rod 476 which is affixed to the side panels 440*a* and 440*b*. The stapler slider 470 is slidable along the guide rod 476 in a direction perpendicular to the sheet surface of FIG. 19. A guide roller 478 is mounted on a lower portion of the stapler slider 470 to roll on the surface of a stay 480 which is mounted on the finisher body. A guide roller 484 is rotatably mounted on the stapler slider 470 and rollably contacts the cam surface of a guide cam 482. The guide cam 482 is affixed to the stay 480 and has the cam surface at the upper end thereof. As a result, the stapler slider 470 is movable together with the stapler support 468 in a reciprocating motion in a direction indicated by an arrow K in FIG. 20. The intermediate portion of the guide cam 482 is concave downward to cause the stapler slider 470 to assume an upper position at opposite sides or a lower position at an intermediate section.

A piece 484 is affixed to the upper end of the stapler slider 470 while a home position sensor 486 is mounted on the finisher body. That the stapler S is in a home position is determined when the piece 484 acts on the sensing portion of the home position sensor 486. A stepping motor 488 is mounted on the side panel 440*b* to move the stapler S in the right-and-left direction via a belt 490. Specifically, the belt 490 to be driven by the motor 448 is affixed to the stapler slider 470, so that the stapler slider 470 may move in a reciprocating motion in the right-and-left direction as viewed in FIG. 20. The stapler slider 470, guide roller 478, stay 480, guide cam 482, motor 488 and belt 490 constitute a moving device 492 in combination. Reference fences 494*a* and 494*b* are interposed between the stapler S and the jogger fences 442*a* and 442*b* in such a manner as to be movable in the right-and-left direction independently of the jogger fences 442*a* and 442*b*. The lower end of each reference fence 494*a* or 494*b* has a hook-like configuration to form a pair of holding portions 496*a* or 496*b* which hold the trailing end of a sheet stack with respect to the transport direction. The holding portions 496*a* and the holding portions 496*b* define therebetween engaging portions 498*a* and 498*b*, respectively. The stapler S is selectively engageable with the engaging portions 498*a* or 498*b*. The reference fences 494*a* and 494*b* are movable in the right-and-left direction by being guided by a guide member, not shown. Springs 500 and 502 constantly bias respectively the reference fences 494*a* and 494*b* toward the intermediate between the side panels 440*a* and 440*b*. In the specific condition shown in FIG. 20, the left reference fence 494*a* is located at a home position thereof by the spring 500 because the stapler S is engaged with the engaging portion 498*a* of the fence 494*a*, while the right reference fence 494*b* is returned away from a home position thereof by the spring 502.

As stated above, the reference fences 494*a* and 494*b* for positioning the trailing end of a sheet stack are physically separate from the jogger fences 442*a* and 442*b* and a constantly biased by the springs 500 and 502 toward the center. This, coupled with the fact that the reference fences 494*a* and 494*b* are each movable together with the stapler S, allows the stapler S to staple a sheet stack at any desired position. When the reference 494*a* and 494*b* are intentionally dislocated to, for example, remove a jamming sheet, they will automatically return toward the center due to the springs 500 and 502, insuring the engagement of the stapler S with the reference fence 494*a* or 494*b*. When the stapler S moves in the previously mentioned upper position at either side of the finisher, the engaging portion 498*a* or 498*b* of the reference fence 494*a* or 494*b* is engaged with the stapler S. On the other hand, when the stapler 5 moves in the lower position at the center of the finisher, the engaging portions 498*a* and 498*b* are released from the stapler S. While the stapler S and reference fence 494*a* or 494*b* is connected together by the associated engaging portion 498*a* or 498*b*, the movement of the stapler S is transferred to the associated reference fence 494*a* or 494*b*, causing the reference fence to move together with the stapler S.

A control unit for controlling the stapling position is located in the vicinity of an operation board provided on the copier body 402, FIG. 18. Although not shown, the control unit has a CPU for delivering various control signals on the basis of a predetermined program, an input circuit for transforming the output signals of the sensors 434 and 466, home position sensors and inputs on the operation board of the copier 402 to a format which the CPU can handle, a RAM for storing output data of the CPU, and drivers for driving the motors 446, 462 and 488, solenoids, etc. The CPU drives the solenoids, motors 466, 462 and 488 and so forth via the associated drivers while interchanging signals with the RAM and operation board, according to a predetermined program.

The operation of the illustrative embodiment will be described. The sheet feed by the ADF 404, the copying procedure by the copier 402 and the operation of the discharging section 408 are conventional and will not be described.

Figure 21:
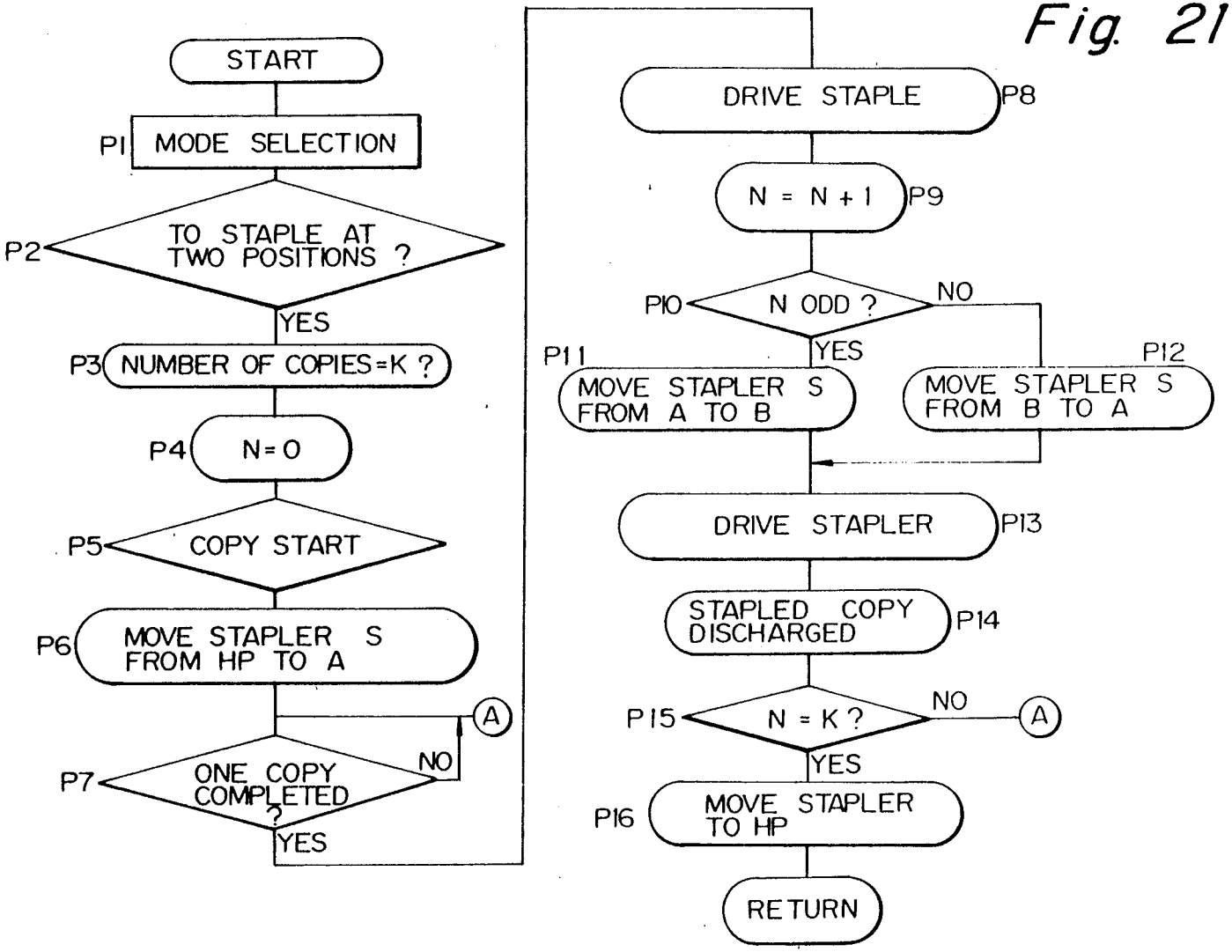
FIG. 21 is a flowchart demonstrating a specific operation of the embodiment.

Referring to FIG. 21, how the staple section 438 of the finisher 410 staples a stack of sheets is demonstrated. The rest of the operation of the finisher 410 is also conventional and will not be described. Assume that the copier produce K copies of M documents, and that each copy is stapled at two positions A and B, FIG. 20.

In FIG. 21, after M documents 414 have been stacked on the tray 412 of the ADF 404, a staple key provided on the operation board of the copier body 402 is pressed to select a staple mode (step P1). It is determined that a stack of sheets should be stapled at the two positions A and B (P2). Numeral keys also provided on the operation board are operated to enter a desired number of copies K (P3). Initially, the number of copies produced N is reset to zero (P4). In this condition, a copy start button provided on the operation board is pressed (or not pressed when a copying operation is not to be started) (P5). Then, the control unit drives the motor 488 to thereby move the belt 490 (P6). As a result, the belt 490 moves the stapler S from the home position (HP) to the position A corresponding to the stapling position A shown in FIG. 20. Subsequently, whether or not one copy of the documents has been completed is determined (P7) and, if the answer is negative, this decision is repeated until the answer changes to positive. On the completion of one copy, the control unit sends a staple signal to the motor associated with the stapler S (P8) with the result that the stapler S staples the copy or sheet stack at the position A. Then, the copy number N is incremented by one (P9), and whether or not the resulting N is odd is determined (P10). Because N is odd at this moment, the control unit causes the motor 488 to move the stapler S from the position A to the other position B (P11) via the belt 490. Thereafter, the control unit drives the motor associated with the stapler S to cause the stapler S to staple the sheet stack at the position B (P13). As the motor 462 drives the discharge belt 454, the pawl 464 of the belt 454 engages with the stapled sheet stack and moves it upward along the jogger fences 442*a* and 442*b* due to the movement of the belt 454 until the sheet stack has been discharged to the staple tray 424 (P14). Whether or not N reached K is determined (P15). If N is not K, i.e., if N is 1, the program returns to the step P7.

When the next copy of the documents is completed as determined in the step P7, the control unit again causes the stapler S to staple the second copy at the position B in the previous stated manner (P8). As N is incremented to 2 (P2), whether or not the resulting N is odd is determined (P10). Because N is even (N=2) at this moment, the control unit causes the motor 488 to move the stapler S from the position B to the position A (S12). After the stapler S has stapled the second copy at the position A (P13), the stapled copy is driven out to the staple tray 424 (P14). Then, whether or not N is K is determined (P25). The steps P7–P14 are repeated until N reaches K. When N reaches K (N=K) as determined in the step P15, the stapler S returns to the home position (P15) to end the stapling operation.

As stated above, the finisher 410 is capable of stapling a stack of sheets at any desired position by the control unit which freely controls the stapling position of a single stapler S. When it is desired to staple each of K copies at two positions A and B, the control unit causes the stapler S having stapled a copy at the positions A and B in this order to staple the next copy at the position B and then the position A. This saves the time otherwise needed for the stapler S to move after stapling the first copy at the position B and thereby allows the stapler S to staple the second copy rapidly. The finisher, therefore, achieves an efficient stapling operation despite a single stapler S. Moreover, the finisher 20 is cost-effective because it is operable efficiently as if it were provided with two staplers.

Figure 22:
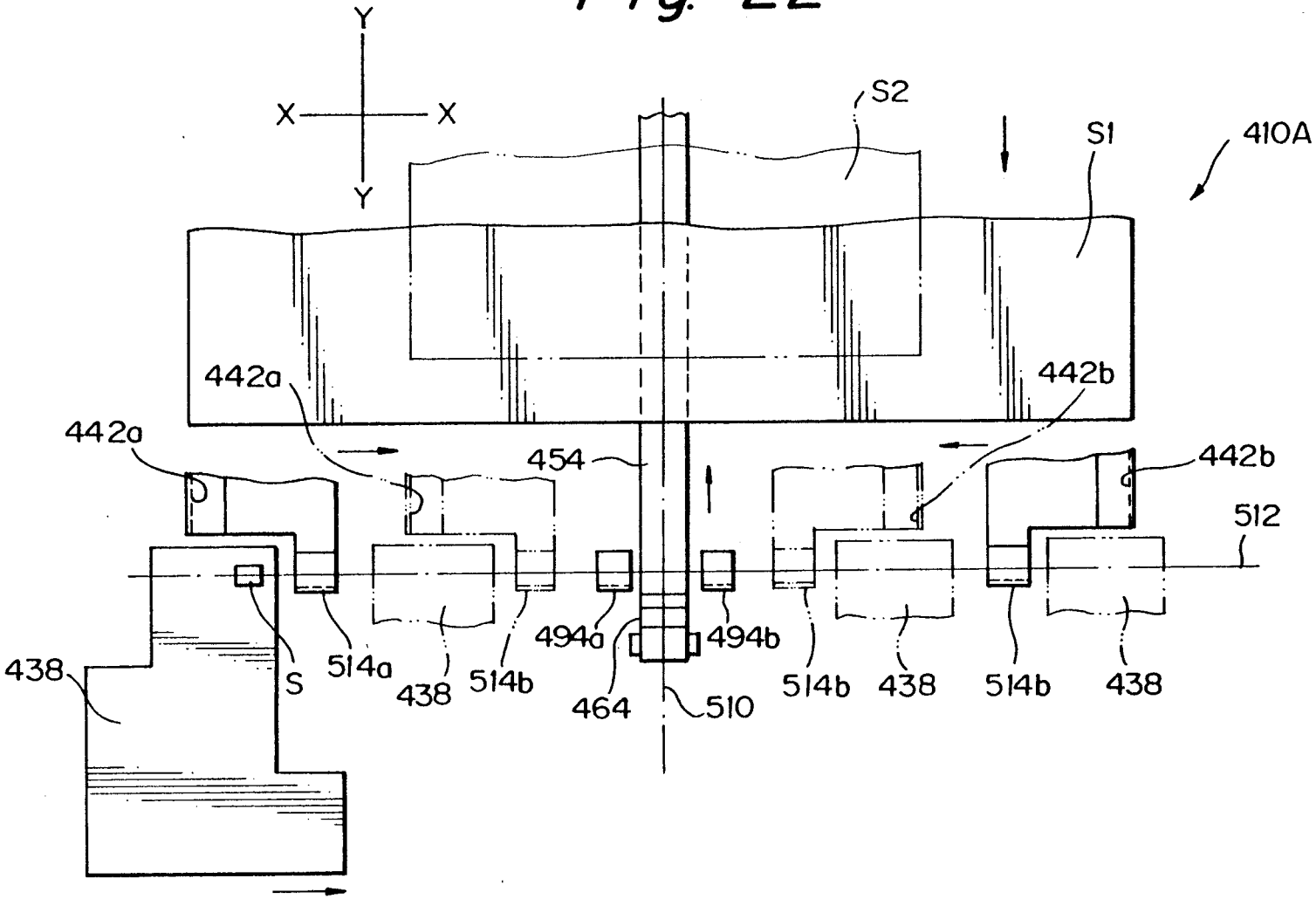
FIGS. 22 and 23 are views showing an alternative embodiment of the present invention.
Figure 23:
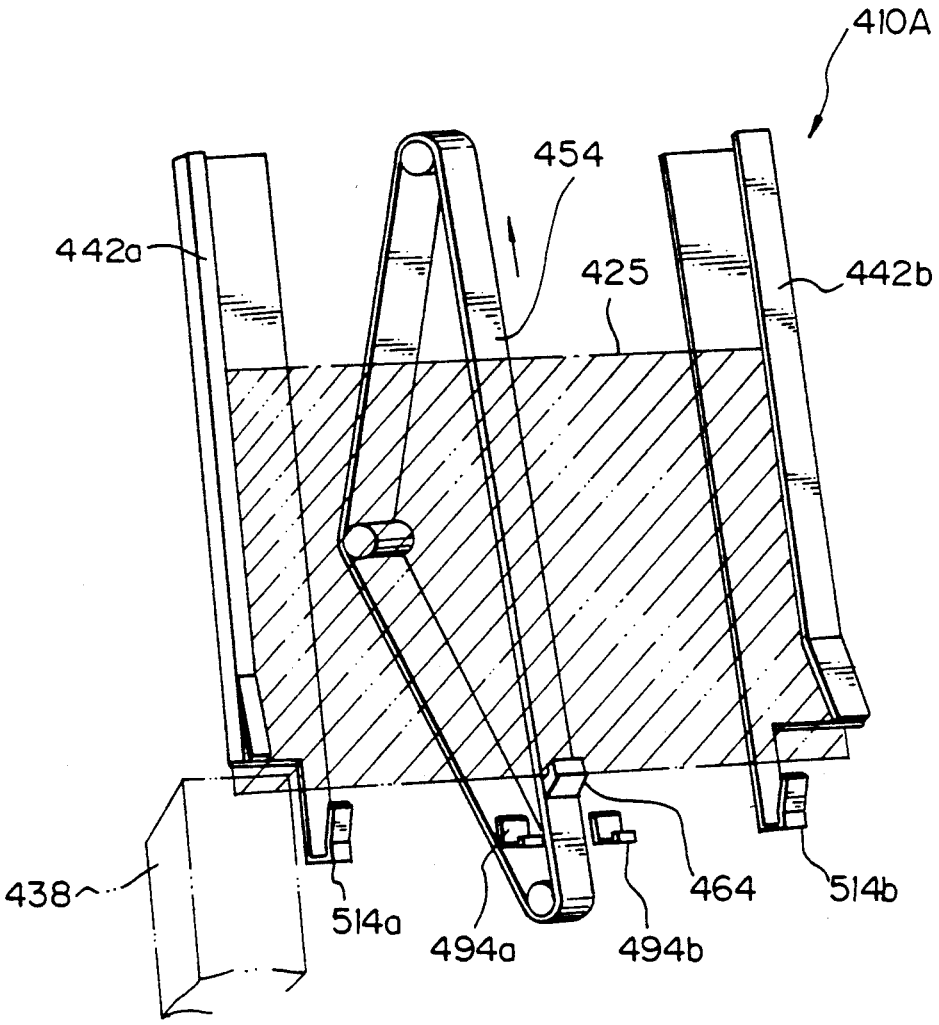

Referring to FIGS. 22 and 23, an alternative embodiment of the present invention is shown. In the figures, the same or similar components and structural elements are designated by the same reference numerals, and redundant description will be avoided for simplicity. As shown, the finisher, generally 410A, has the staple section 438, reference fences 494*a* and 494*b*, and jogger fences 442*a* and 442*b*. The staple section 438 includes the stapler S. The jogger fences 442*a* and 442*b* are automatically positioned in matching relation to the size of sheets to be used. Specifically, the jogger fences 442*a* and 442*b* are movable toward and away from each other over the same distance as each other as measured from the center line 510, i.e., the reference for sheet transport. The stapler S has a stapler driving portion, not shown, which is movable with the staple section 438 independently of the jogger fences 442*a* and 442*b* along a line 512 on which the stapling positions are located. Specifically, the staple section 438 is moved by the staple motor along a guide rod, not shown, which is parallel to the line 512. Part of the members supporting the jogger fences 442*a* and 442*b* are each configured as a holding portion 514*a* or 514*b* which extends across the line 512 for supporting the end of a sheet stack. The staple section 438 is selectively retracted so that the holding portions 514*a* and 514*b* may not interfere with the section 438 while the latter is in movement.

The staple section 438 moves to a predetermined stapling position and then actuates the stapler S to bind a stack of sheets.

Figure 24A:
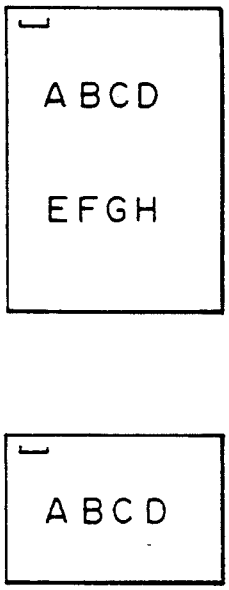
FIGS. 24A-24D show specific positions where a stack of sheets may be bound.
Figure 24B:
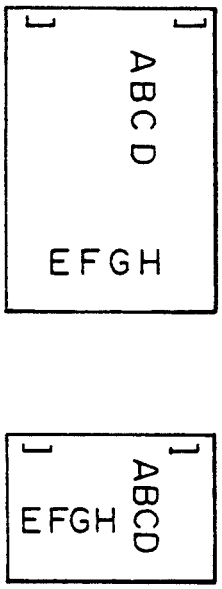
Figure 24C:
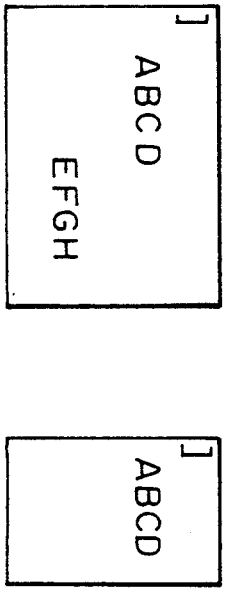
Figure 24D:
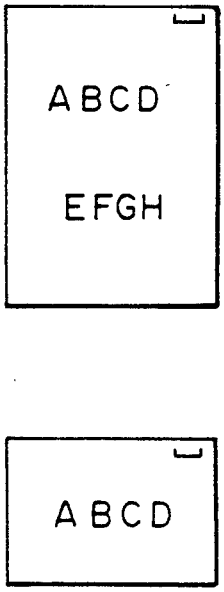

In FIG. 22, assume that the left-hand side and the right-hand side with respect to the center line 510 are the front and the rear, respectively. Then, when characters are printed out on sheets in the orientation shown in FIG. 24A, a front staple mode is selected for stapling the sheets only at the upper front corner. When characters are arranged on sheets in the orientation shown in FIG. 24B, a both-end mode are selected for stapling the sheets at the upper front and upper rear corners. Further, when characters are arranged on sheets in the orientation shown in FIG. 24C, a rear mode is selected for stapling the sheets only at the upper rear corner. At this instant, should the rear mode be selected for sheets oriented as shown in shown in FIG. 24D, the stapling position would be different from the ordinary one and would make the resulting copy awkward to handle.

Figure 25:
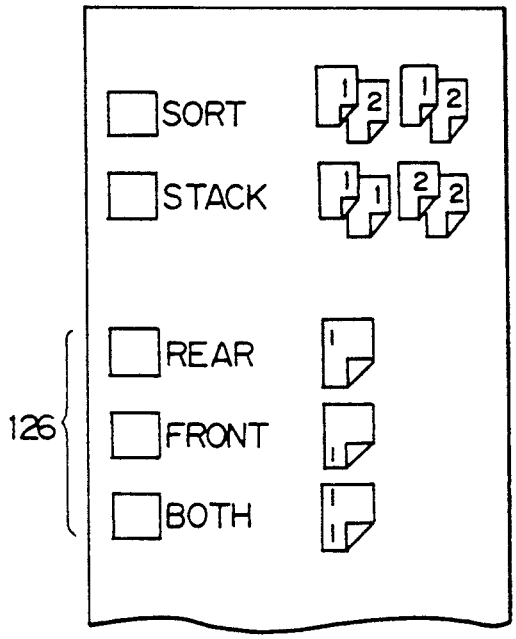
FIG. 25 shows staple mode keys arranged on the copier.
Figure 26:
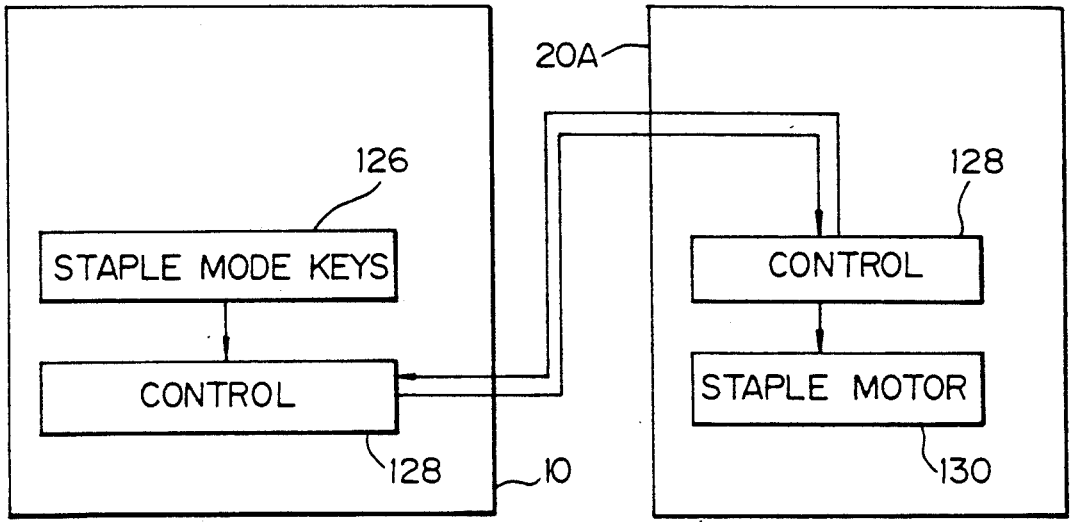
FIG. 26 is a block diagram schematically showing a control system for controlling the movement of a stapler.

As shown in FIG. 25, staple mode keys 516 are arranged on the copier 400. Assume that one of the staple mode keys 516 is operated to select a particular staple mode. Then, as shown in FIG. 26, the entered information is transferred to a control unit 518 built in the copier 400 and further to a control unit 520 built in the finisher 410A. As a result, a particular position matching the sheet size is calculated, and a staple motor 522 is driven to move the stapler S to such a position. As soon as a copy having a predetermined number of pages has been completed, the stapler S is driven to bind it.

In this embodiment, the single stapler S staples a copy at one position in the rear mode or at two positions in the both-side mode. In the both-side mode, after the stapler S has stapled a copy at two positions, i.e., ended one job, returns to the home position thereof while the first sheet of the next copy arrives at the staple section 438. Of course, such a movement of the stapler S to the home position consumes a longer period of time than when the stapler S staples a copy only at one position.

Figure 27:
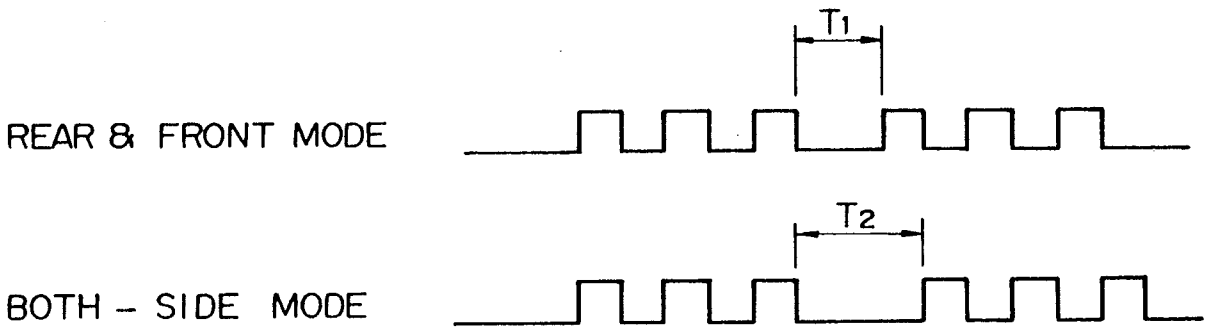
FIG. 27 is a timing chart showing the intervals between successive jobs assigned to different modes.
Figure 28A:
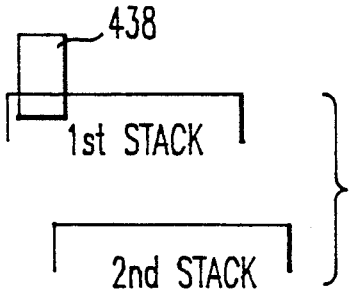
FIG. 28 shows a single stapler which can move between various positions.
Figure 28D:
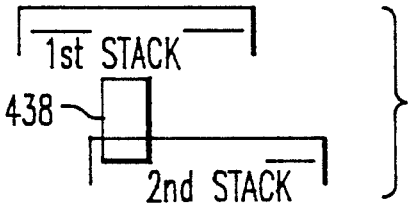
Figure 28B:
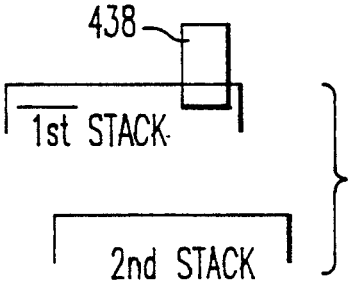
Figure 28E:
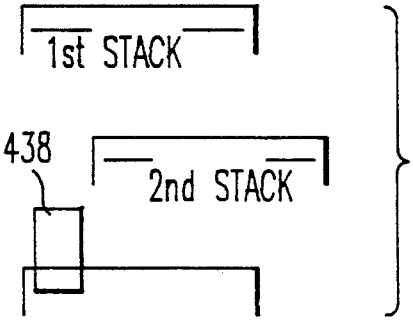
Figure 28C:
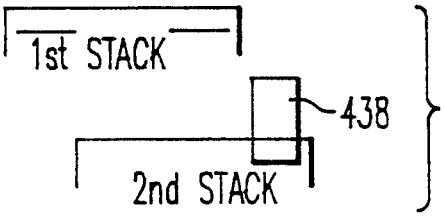

It is, therefore, necessary to switch over the interval or waiting time between successive jobs depending on the number of stapling positions, so that the first sheet of the next copy may not contact the stapler S. To meet this requirement, as shown in FIG. 27, the illustrative embodiment selects an interval $T_1$ between successive jobs when the front mode or the rear mode is set up or selects another interval $T_2$ ($T_2$) $T_1$) when the both-side mode is set up. The switchover between the intervals $T_1$ and $T_2$ may be effected by manipulating the timing for the feed of a sheet. Alternatively, an arrangement may be made such that the copier 400 sends a staple mode to the finisher 410A over an optical fiber, and the finisher 410A in turn sends a waiting time between jobs matching the staple mode to the copier 400. Such a procedure is practicable with the system shown in FIG. 26.

After the stapling operation, the discharge belt 454 is driven in a manner shown in FIG. 23 to catch the sheet stack 524 with the pawl 464 thereof. As a result, the copy is driven out to the staple tray 424.

As stated above, the illustrative embodiment is also capable of stapling a stack of sheets at a single position or two positions by the stapler S, as desired. In addition, the embodiment prevents a sheet from entering the staple section 438 while the stapler S is in movement.

Figure 29:
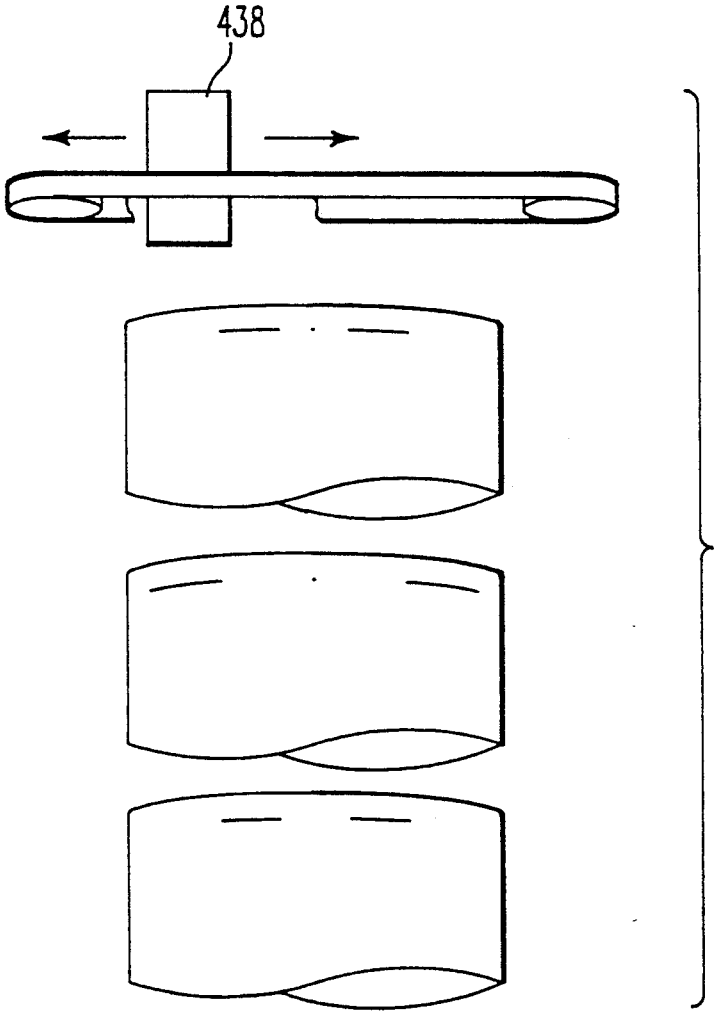
FIG. 29 shows a mechanism for moving a single stapler between positions.

FIG. 28 illustrates the relationship between a single staper 438 which can move between various positions and the staples formed. FIG. 29 shows the mechanism for moving stapler 438 between the various positions.

In summary, the present invention achieves various advantages, as enumerated below.

(1) Efficient and easy manipulations are promoted because the operator can reach a discharged paper stack without bending over. An extra paper discharge path is eliminated to miniaturize an image forming apparatus.

(2) A paper stack can be stapled automatically at an adequate position or positions thereof.

(3) A stapled paper stack is discharged stably, especially without being loosened at the discharge side. A number of paper sheets bound together can be directly driven out of a stapling device onto a tray.

(4) A stapling error is detected easily and accurately. This promotes prompt processing for coping with a stapling error.

(5) Paper sheets are neatly positioned and bound at a paper transport position. Hence, the period of time necessary for positioning and binding paper sheets is reduced to enhance efficient stapling operations.

(6) Jogger fences regulate incoming paper sheets at any desired position, so that the paper sheets can be stapled at any suitable position or positions thereof.

(7) A jam of a stapled paper stack is detected readily and surely to promote rapid processing.

(8) Paper sheets are surely fed into the stapling device by a simple construction, even if they are curled.

(9) Paper sheets driven out of an image forming apparatus after a stapling function has failed are protected while allowing the other processing to be effected efficiently.

(10) The finisher is capable of stapling a stack of sheets at any desired position by the control unit which freely controls the stapling position of a single stapler S. When it is desired to staple each of K copies at two positions A and B, control is effected such that the stapler S having stapled a copy at the positions A and B in this order staples the next copy at the position B and then the position A. This saves the time otherwise needed for the stapler S to move after stapling the first copy at the position B and thereby allows the stapler S to staple the second copy rapidly. The finisher, therefore, achieves an efficient stapling operation despite a single stapler S. Moreover, the finisher is cost-effective because it is operable efficiently as if it were provided with two staplers.

Various modifications will become possible for those skilled in the art after receiving the teachings of the present disclosure without departing from the scope thereof.

What is claimed is:

1. A finisher capable of binding a stack of sheets sequentially discharged from image forming equipment at a plurality of desired positions, comprising:

stapling means comprising a single stapler for binding said stack of sheets at said desired positions;

moving means for moving said stapling means via said desired positions; and control means for controlling said stapling means and said moving means such that said stack of sheets is stapled at particular positions selected in matching relation to a designated staple mode and such that when said stapling means staples said stack of sheets at said plurality of positions, the last stapling position of said stack is the first stapling position of the next stack of sheets.

2. A finisher capable of binding a stack of sheets sequentially discharged from image forming equipment at a plurality of desired positions, comprising:

stapling means comprising a single stapler for binding said stack of sheets at said desired positions;

moving means for moving said stapling means via said desired positions; and control means for controlling said stapling means and said moving means such that said stack of sheets is stapled at particular positions selected in matching relation to a designated staple mode and for controlling said moving means such that the interval between the end of a stapling operation for stapling a stack of sheets at a plurality of positions and the beginning of a stapling operation for stapling the next stack of sheets is changed on the basis of a staple mode selected.

3. A finisher capable of binding a stack of sheets sequentially discharged from image forming equipment at a plurality of desired positions, comprising:

a single stapler for binding said stack of sheets at said desired positions;

selecting means for selecting said desired positions;

moving means for moving said stapler in a direction substantially parallel to an edge of said stack of sheets; and control means for controlling said stapler and said moving means such that said stack of sheets is stapled at particular positions selected by said selecting means and such that when said stapler staples said stack of sheets at said plurality of positions, the last stapling position of said stack is the first stapling position of the next stack of sheets.

* * * * *